US010513388B2

(12) United States Patent
Wetton et al.

(10) Patent No.: US 10,513,388 B2
(45) Date of Patent: Dec. 24, 2019

(54) PACKAGING AND METHOD OF OPENING

(71) Applicant: MONDELEZ UK R&D LIMITED, Birmingham (GB)

(72) Inventors: Amy Wetton, Birmingham (GB); Vincenzo Disavino, Birmingham (GB); Jo-Ann Clark, Birmingham (GB); Adam Lloyd, Birmingham (GB)

(73) Assignee: MONDELEZ UK R&D LIMITED, Birmingham (GB)

( * ) Notice: Subject to any disclaimer, the term of this patent is extended or adjusted under 35 U.S.C. 154(b) by 220 days.

(21) Appl. No.: 14/765,116

(22) PCT Filed: Mar. 6, 2014

(86) PCT No.: PCT/GB2014/050665
§ 371 (c)(1),
(2) Date: Jul. 31, 2015

(87) PCT Pub. No.: WO2014/135882
PCT Pub. Date: Sep. 12, 2014

(65) Prior Publication Data

US 2015/0375925 A1 Dec. 31, 2015

(30) Foreign Application Priority Data

Mar. 7, 2013 (GB) ..... 1304167.8

(51) Int. Cl.
*B65D 85/60* (2006.01)
*B65D 73/00* (2006.01)
(Continued)

(52) U.S. Cl.
CPC ..... *B65D 85/60* (2013.01); *B65B 43/08* (2013.01); *B65B 61/18* (2013.01);
(Continued)

(58) Field of Classification Search
CPC ..... B65B 43/08; B65B 61/18; B65D 8/00; B65D 8/04; B65D 11/02; B65D 17/02;
(Continued)

(56) References Cited

U.S. PATENT DOCUMENTS 1,419,905 A 6/1922 Hostetter
1,684,421 A * 9/1928 Thompson ..... B65D 75/68 426/410
(Continued)

FOREIGN PATENT DOCUMENTS

AU 704843 B2 10/1996
AU 717400 B2 4/1997
(Continued)

OTHER PUBLICATIONS

Patent Cooperation Treaty; International Search Report; PCT/GB2014/050665; International Filing Date: Mar. 6, 2014; 6 pages.
(Continued)

*Primary Examiner* — Bryon P Gehman
(74) *Attorney, Agent, or Firm* — Cantor Colburn LLP

(57) ABSTRACT

A confectionery packaging is provided comprising a first part formed from a preformed shell that is substantially rigid so that the part maintains it shape. The first part holds the product to be packaged, which in the Figures is shown as a confectionery egg. Main surfaces of the first part are shaped so as to substantially conform to the shape of the confectionery egg. Consequently an open mouth to the part is provided. The egg is accessible through the open mouth. A flange is formed about the perimeter of the open mouth. The flange extends away from the main surfaces and continuously about the perimeter of the mouth and extends a substantial distance therefrom in order to provide a surface against which a second part. The confectionery packaging forms a sealed enclosure about the egg by sealing a second
(Continued)

part to the flange. To open the packaging, the film is separated from the first part, for instance by peeling back the film. There is therefore provided a packaging which provides an improved protection to the egg and to which graphics can be more reliably applied and reproduced. The preformed part also provides a convenient holder for the egg to allow the user to consume the egg without having to touch the egg itself.

20 Claims, 13 Drawing Sheets

(51) Int. Cl.

| | |
|---|---|
| ***B65B 43/08*** | (2006.01) |
| ***B65B 61/18*** | (2006.01) |
| ***B65D 75/30*** | (2006.01) |
| ***B65D 75/54*** | (2006.01) |
| ***B65D 75/58*** | (2006.01) |

(52) U.S. Cl.
CPC ..... *B65D 73/0092* (2013.01); *B65D 75/30* (2013.01); *B65D 75/54* (2013.01); *B65D 75/5827* (2013.01)

(58) Field of Classification Search
CPC ..... B65D 17/06; B65D 17/168; B65D 25/52; B65D 73/0092; B65D 75/22; B65D 75/30; B65D 75/327; B65D 75/54; B65D 75/58; B65D 75/5827; B65D 85/60; B65D 85/76; B65D 73/00; B65D 77/00; A23G 3/50
USPC ..... 206/484, 562–564; 220/4.21, 4.24, 4.25, 220/23.83, 694
See application file for complete search history.

(56) References Cited

U.S. PATENT DOCUMENTS 3,127,993 A 4/1964 Phipps
3,161,156 A 12/1964 Batista et al.
3,164,478 A 1/1965 Bostrom
3,292,840 A 12/1966 Schmidt
3,472,368 A 10/1969 Hellstrom
3,741,379 A * 6/1973 Kappler ..... B65D 55/02 220/4.21
3,983,658 A 10/1976 De Sanz
4,221,293 A 9/1980 Anthony
4,244,470 A * 1/1981 Burnham ..... A23G 9/503 220/4.25
4,844,243 A 7/1989 Stiles
4,921,137 A 5/1990 Heijenga
5,176,272 A 1/1993 Ryan
5,209,345 A 5/1993 Haugabook
5,287,979 A 2/1994 Bourgeois
5,360,133 A 11/1994 Corby et al.
5,411,178 A 5/1995 Roders et al.
5,480,091 A 1/1996 Stout
5,529,224 A 6/1996 Chan et al.
5,538,131 A 7/1996 Harrelson
5,634,569 A 6/1997 Decoster
5,639,017 A 6/1997 Fogle
D380,381 S 7/1997 Krupa et al.
D381,263 S 7/1997 O'Brien et al.
D382,795 S 8/1997 Abayhan et al.
D382,796 S 8/1997 Mangla
D385,784 S 11/1997 Krupa et al.
5,685,420 A 11/1997 Martin et al.
D388,324 S 12/1997 Bonnard
D392,883 S 3/1998 Ferrin
D393,204 S 4/1998 Goins et al.
D394,807 S 6/1998 Krupa et al.
D395,599 S 6/1998 Wyslotsky
5,775,161 A 7/1998 Caleffi et al.
5,779,079 A 7/1998 Lee
D396,633 S 8/1998 Guillin
D397,610 S 9/1998 Cooper
D398,844 S 9/1998 Oberloier
D398,845 S 9/1998 Wyslotsky
D398,846 S 9/1998 Wyslotsky
5,839,609 A 11/1998 Zakensberg
5,839,634 A 11/1998 Pollard et al.
5,850,964 A 12/1998 Rosenbaum et al.
D404,642 S 1/1999 Major
5,860,590 A 1/1999 Blomfield et al.
5,881,721 A 3/1999 Bunce et al.
D409,085 S 5/1999 Wyslotsky et al.
5,906,313 A 5/1999 Oliff
D411,741 S 6/1999 Wilson et al.
5,921,681 A 7/1999 Money
D412,843 S 8/1999 Melzer
5,941,453 A 8/1999 Oliff
5,955,099 A 9/1999 White
5,992,619 A * 11/1999 Milano ..... B65D 75/32 220/4.25
6,000,539 A 12/1999 Stewart-Cox et al.
D418,410 S 1/2000 Smith
6,015,084 A 1/2000 Mathieu et al.
6,018,299 A 1/2000 Eberhardt
6,032,502 A 3/2000 Halasz et al.
6,050,402 A 4/2000 Walter
6,050,438 A * 4/2000 Kovens ..... B65D 11/02 220/4.24
6,065,590 A 5/2000 Spivey
6,065,602 A 5/2000 Nielsen
6,079,249 A 6/2000 Turner et al.
6,079,618 A 6/2000 Hedberg et al.
D427,902 S 7/2000 Hayes et al.
6,085,942 A 7/2000 Redmond
6,092,687 A 7/2000 Hupp et al.
6,094,884 A 8/2000 Christensen et al.
6,099,872 A 8/2000 Whetstone, Jr.
6,113,961 A 9/2000 Polster
D431,459 S 10/2000 Lee
D431,461 S 10/2000 Glassman
D433,328 S 11/2000 Loughnane
D433,937 S 11/2000 Glassman
D436,532 S 1/2001 Richardson
D436,860 S 1/2001 Raso
6,179,147 B1 1/2001 Mogard et al.
D437,220 S 2/2001 Knutson et al.
D438,103 S 2/2001 Edwards et al.
6,182,847 B1 2/2001 Shu
D438,461 S 3/2001 Yamagishi
6,196,406 B1 * 3/2001 Ennis ..... B65D 71/02 220/23.83
D440,490 S 4/2001 Lizzio
6,209,742 B1 4/2001 Overholt et al.
6,216,905 B1 4/2001 Mogard et al.
6,220,779 B1 4/2001 Warner et al.
D445,673 S 7/2001 Richardson
D446,450 S 8/2001 Zettle et al.
D447,684 S 9/2001 Hogman
D448,283 S 9/2001 Chapman
6,283,221 B2 9/2001 Hurray et al.
D449,226 S 10/2001 Hedstrom et al.
6,296,120 B1 * 10/2001 Danko ..... B65D 5/503 206/564
6,315,123 B1 11/2001 Ikeda
6,352,033 B1 3/2002 Brede et al.
6,357,631 B1 3/2002 Zaksenberg
6,367,651 B2 4/2002 Laib et al.
6,370,842 B1 4/2002 Moriyama et al.
6,382,447 B1 5/2002 Loeschen
6,394,296 B1 5/2002 Elvin-Jensen et al.
D459,988 S 7/2002 Hogman
D459,989 S 7/2002 Hogman
6,427,908 B1 8/2002 Laker et al.
6,431,436 B1 8/2002 Evers
6,463,776 B1 10/2002 Enoki et al.
6,467,614 B1 10/2002 Tallier et al.

(56) References Cited

U.S. PATENT DOCUMENTS 6,474,468 B1 11/2002 Griffith
6,484,550 B2 11/2002 Halasz et al.
D466,405 S 12/2002 Lee
6,499,329 B1 12/2002 Enoki et al.
6,501,046 B1 12/2002 Miller et al.
D469,690 S 2/2003 Pau
6,513,306 B1 2/2003 Milano
D472,803 S 4/2003 Saunders
6,554,181 B1 4/2003 Dammers et al.
6,557,700 B1 5/2003 Wharton
6,557,731 B1 5/2003 Lyon et al.
D475,288 S 6/2003 Hoffmann et al.
D475,581 S 6/2003 Lillelund et al.
D480,300 S 10/2003 Lee
D480,638 S 10/2003 Lee
D485,470 S 1/2004 Willis
6,683,289 B2 1/2004 Whitmore et al.
D486,718 S 2/2004 Passerini
6,685,020 B2 2/2004 Briseboi et al.
6,688,832 B1 2/2004 Zysset
D487,563 S 3/2004 Ghatlia et al.
6,702,140 B1 3/2004 Sollo
D488,375 S 4/2004 Risgalla
6,732,869 B1 5/2004 Oren et al.
6,736,260 B2 5/2004 Gomes et al.
6,736,287 B2 5/2004 Sauer et al.
D493,105 S 7/2004 Childs et al.
6,787,205 B1 9/2004 Aho et al.
6,793,094 B2 * 9/2004 Turnbough ..... A47G 19/2272 215/11.1
6,608,351 B1 10/2004 Brown et al.
D500,442 S 1/2005 Chiang
D500,443 S 1/2005 Chiang
D502,095 S 2/2005 Tucker et al.
D502,869 S 3/2005 Clarke
D504,286 S 4/2005 de Cleir
6,877,600 B2 4/2005 Sutherland
D505,081 S 5/2005 Risgalla
6,887,030 B2 5/2005 Bowman et al.
D505,861 S 6/2005 Risgalla
D506,130 S 6/2005 Metaxatos
D506,146 S 6/2005 Hall
D506,147 S 6/2005 Hall
D506,926 S 7/2005 Halliday et al.
6,912,829 B2 * 7/2005 Costantini ..... B65D 75/32 426/392
D508,647 S 8/2005 Silver et al.
6,929,171 B1 8/2005 Thiersch
D509,727 S 9/2005 Suckle et al.
6,959,577 B2 11/2005 Jentzsch
6,959,834 B2 11/2005 McDonald
6,974,612 B1 12/2005 Frisk et al.
6,976,577 B2 12/2005 Devine
D515,915 S 2/2006 Karim
7,004,897 B2 2/2006 Spivey, Sr.
7,007,836 B2 3/2006 Smalley
7,017,796 B2 3/2006 Ishikaina
D520,357 S 5/2006 Terrasi
7,044,319 B2 5/2006 Overholt et al.
D522,857 S 6/2006 Tabeshnekoo
7,066,342 B2 6/2006 Baechle et al.
D524,642 S 7/2006 Suckle et al.
D524,645 S 7/2006 Lamasney
7,073,680 B2 7/2006 Boback et al.
7,086,572 B2 8/2006 Socier et al.
7,090,317 B2 8/2006 Remmers
D528,908 S 9/2006 Faktorovich et al.
D530,197 S 10/2006 Lamasney
D531,022 S 10/2006 Au
D531,029 S 10/2006 Gomoll et al.
D531,894 S 11/2006 Ramirez et al.
D534,420 S 1/2007 Fager
D534,421 S 1/2007 Tanner
D534,423 S 1/2007 Tanner
7,159,760 B2 1/2007 Pluck et al.
D536,611 S 2/2007 Peck
D536,992 S 2/2007 Garg et al.
D539,134 S 3/2007 Wallach
7,191,931 B2 3/2007 Damkjaer
D540,663 S 4/2007 Tanner
7,208,009 B2 4/2007 Richter
D542,675 S 5/2007 Luxton et al.
7,211,035 B2 5/2007 Ichikawa et al.
D547,176 S 7/2007 Sansoldo
D549,571 S 8/2007 Althouse et al.
D550,077 S 9/2007 Lagreca et al.
D550,553 S 9/2007 Yalinkaya
7,270,245 B2 9/2007 Cheng et al.
D552,468 S 10/2007 Seum et al.
D552,982 S 10/2007 Liebe
D553,489 S 10/2007 Lambert et al.
D553,490 S 10/2007 Yang
7,284,662 B2 10/2007 DeBusk et al.
7,287,645 B2 10/2007 Hyun
D554,498 S 11/2007 Lovett
D556,569 S 12/2007 Stein et al.
D556,571 S 12/2007 Jalet
D557,601 S 12/2007 Minidis
7,314,482 B2 1/2008 Richter et al.
D561,579 S 2/2008 Aronson et al.
D562,128 S 2/2008 Van de Velde
D562,678 S 2/2008 Shaver et al.
7,325,686 B2 2/2008 Aldridge
D564,349 S 3/2008 Schumaier
D564,899 S 3/2008 Hardy
7,357,272 B2 4/2008 Maxwell
D569,243 S 5/2008 Kidd et al.
D569,269 S 5/2008 Lamasney
7,370,774 B2 5/2008 Watson et al.
D571,228 S 6/2008 Maslowski
D571,654 S 6/2008 Maroofian et al.
D571,656 S 6/2008 Maslowski
7,383,954 B2 6/2008 Morrison
7,389,875 B2 6/2008 Sandberg et al.
D572,582 S 7/2008 Lymn et al.
D573,015 S 7/2008 Chen
7,392,683 B2 7/2008 Luthi et al.
D576,875 S 9/2008 Steiger et al.
D577,577 S 9/2008 Lee et al.
D577,578 S 9/2008 Lymn et al.
D577,579 S 9/2008 Lymn et al.
7,419,068 B2 9/2008 Bushby
D577,995 S 10/2008 Lovett
D578,387 S 10/2008 Lovett
D578,388 S 10/2008 Lymn et al.
D578,877 S 10/2008 Lovett
D579,326 S 10/2008 Chen
D579,767 S 11/2008 Wallach
D580,750 S 11/2008 Claassen et al.
D581,266 S 11/2008 Vovan
7,456,376 B2 11/2008 Berthault
D581,781 S 12/2008 Enriquez
D583,657 S 12/2008 Follansbee et al.
D583,658 S 12/2008 Follansbee et al.
D583,659 S 12/2008 Lyon et al.
D584,964 S 1/2009 Schulz et al.
7,475,777 B2 1/2009 Fung et al.
D585,734 S 2/2009 Doliwa
D585,735 S 2/2009 Vovan et al.
D586,665 S 2/2009 Murgida et al.
D587,108 S 2/2009 Maslowski
7,484,641 B2 2/2009 Casale et al.
D587,567 S 3/2009 Peyser et al.
D587,993 S 3/2009 Vovan
D588,932 S 3/2009 Murray
D589,340 S 3/2009 Busse et al.
D589,341 S 3/2009 Busse et al.
D589,342 S 3/2009 Maslowski
D589,790 S 4/2009 Shaver et al.
D589,796 S 4/2009 McGeough
7,520,959 B2 4/2009 Kikuchi
D592,494 S 5/2009 Wichowski
D592,497 S 5/2009 Brown
7,527,152 B2 5/2009 Lentner et al.

(56) References Cited

U.S. PATENT DOCUMENTS 7,549,550 B2 6/2009 Smyers et al.
7,552,833 B2 6/2009 Tsutsui et al.
D596,935 S 7/2009 Golota et al.
D596,954 S 7/2009 Jimenez et al.
D601,010 S 9/2009 Ballard et al.
D601,011 S 9/2009 Maslowski
D601,013 S 9/2009 Petitjean
D601,014 S 9/2009 Petitjean
D601,015 S 9/2009 Shaver et al.
D601,304 S 9/2009 McClellan
7,582,242 B2 9/2009 Kolanus
D601,884 S 10/2009 Andre et al.
7,597,244 B2 10/2009 Boldrini et al.
7,604,117 B2 10/2009 Bourgoin et al.
D605,501 S 12/2009 Pham et al.
D605,530 S 12/2009 Sorrentino et al.
D606,392 S 12/2009 Prevost
7,624,673 B2 12/2009 Zanetti
7,628,296 B2 12/2009 Rudolph
D608,192 S 1/2010 L'Hoste et al.
D609,085 S 2/2010 Brachman et al.
D609,561 S 2/2010 Baker et al.
7,661,564 B2 2/2010 Delbarre
D611,805 S 3/2010 Barniquel
D614,490 S 4/2010 Ouimette et al.
D614,491 S 4/2010 Rhoad
7,699,163 B2 4/2010 Gomes et al.
D614,948 S 5/2010 Lablaine et al.
D614,950 S 5/2010 Colacitti
D615,395 S 5/2010 Jefferies et al.
D615,401 S 5/2010 Ouimette et al.
D615,858 S 5/2010 Prevost
D615,859 S 5/2010 Barbier
D616,738 S 6/2010 Andre et al.
D618,539 S 6/2010 Ruth
D618,540 S 6/2010 Ruth
D618,547 S 6/2010 Manning et al.
7,748,563 B2 7/2010 Turner et al.
7,757,843 B2 7/2010 Katsis
D620,790 S 8/2010 Lovett
D622,588 S 8/2010 Wichmann et al.
D622,617 S 8/2010 Sorrentino et al.
D623,935 S 9/2010 Kim et al.
D624,399 S 9/2010 Hansen et al.
D624,402 S 9/2010 Hansen et al.
D624,403 S 9/2010 Hansen et al.
D624,785 S 10/2010 Rousselin
D624,815 S 10/2010 Hansen et al.
D625,180 S 10/2010 Enriquez
7,806,314 B2 10/2010 Sutherland
7,819,249 B2 10/2010 Han
D627,221 S 11/2010 Kovatch
D628,062 S 11/2010 Snedden et al.
7,828,198 B2 11/2010 Boldrini et al.
7,832,075 B2 11/2010 De Guerry et al.
7,838,846 B2 * 11/2010 Pinsky ..... A46B 17/06 250/454.11
D628,470 S 12/2010 Golota et al.
D628,473 S 12/2010 Golota et al.
D628,475 S 12/2010 Snedden et al.
D628,478 S 12/2010 Snedden et al.
D628,479 S 12/2010 Snedden et al.
D630,091 S 1/2011 Schick
D631,337 S 1/2011 Prevost
D631,338 S 1/2011 Prevost
D631,371 S 1/2011 Borgheim et al.
7,862,318 B2 1/2011 Middleton et al.
7,870,980 B2 1/2011 Wilson et al.
7,871,651 B2 * 1/2011 Sinichko ..... A23G 1/505 426/106
7,874,421 B2 1/2011 Bardet
D632,167 S 2/2011 Sauriol et al.
D632,170 S 2/2011 Lawrence et al.
D632,955 S 2/2011 Smith, III et al.
D632,956 S 2/2011 Fuller et al.
D633,380 S 3/2011 Reynolds
D634,188 S 3/2011 Sellari et al.
D634,616 S 3/2011 Hansen et al.
D634,617 S 3/2011 Sellari et al.
D634,618 S 3/2011 Colacitti
D635,848 S 4/2011 Lawrence et al.
D636,258 S 4/2011 Freeman et al.
7,922,019 B2 4/2011 Granger
D637,482 S 5/2011 Snedden et al.
D637,483 S 5/2011 Snedden et al.
D637,484 S 5/2011 Winkler
D637,902 S 5/2011 Evon
D638,701 S 5/2011 Shapiro et al.
7,951,057 B2 5/2011 Robertson et al.
D639,156 S 6/2011 Guillemin et al.
D640,129 S 6/2011 Sifuentes et al.
D640,130 S 6/2011 Golota et al.
D640,544 S 6/2011 Sifuentes et al.
D640,547 S 6/2011 Guillemin et al.
D640,548 S 6/2011 Lawrence et al.
D640,550 S 6/2011 Snedden et al.
7,959,032 B2 6/2011 Bolli
D640,921 S 7/2011 Caldwell et al.
D641,233 S 7/2011 Pugh
D641,616 S 7/2011 Prevost
D641,642 S 7/2011 Caldwell et al.
7,975,989 B2 7/2011 Romanyszyn et al.
D643,311 S 8/2011 Meyers
D643,713 S 8/2011 Lawrence et al.
7,997,436 B2 8/2011 Bolli
7,998,047 B2 8/2011 Spivey, Sr. et al.
8,003,178 B2 8/2011 Kim et al.
D645,339 S 9/2011 Oakes
D645,737 S 9/2011 Oakes
D645,764 S 9/2011 Mathis et al.
D646,561 S 10/2011 Pugh
D646,564 S 10/2011 Freeman et al.
D646,969 S 10/2011 Snedden et al.
8,038,918 B2 10/2011 Jalet et al.
8,042,728 B2 10/2011 Braoudakis
D647,792 S 11/2011 Mathis et al.
D649,448 S 11/2011 Wu
8,051,982 B2 11/2011 McDonald
8,053,009 B2 * 11/2011 Bourguignon ..... B65D 1/0207 220/62.13
8,066,141 B2 11/2011 Casale et al.
D651,096 S 12/2011 Nakagiri
8,070,052 B2 12/2011 Spivey, Sr. et al.
D652,716 S 1/2012 Snedden et al.
8,087,526 B2 1/2012 Dovey et al.
8,091,703 B2 1/2012 Marchetti et al.
8,100,320 B2 1/2012 Brand
8,104,319 B2 1/2012 Turner et al.
D653,533 S 2/2012 Brachman et al.
D653,557 S 2/2012 Anton Villa
D654,788 S 2/2012 Bougoulas et al.
D655,154 S 3/2012 Amos et al.
D655,201 S 3/2012 Schuch
D656,008 S 3/2012 Meech et al.
8,127,518 B2 3/2012 Ford
D656,843 S 4/2012 Schleining
D657,237 S 4/2012 Allers et al.
D658,055 S 4/2012 Kurita et al.
8,158,226 B2 4/2012 Oshita et al.
D658,979 S 5/2012 Gordon et al.
D660,718 S 5/2012 McDermott et al.
8,172,086 B2 5/2012 Aldridge et al.
8,177,068 B2 5/2012 Dias
8,196,805 B2 6/2012 Brand et al.
8,205,787 B2 6/2012 Panduro, Jr. et al.
8,210,538 B2 * 7/2012 Shoemaker, Jr. ..... A63F 9/30 273/148 R
8,231,001 B2 7/2012 Boon et al.
8,235,008 B2 8/2012 Axelrod et al.
8,261,964 B2 9/2012 Raupach et al.
8,272,559 B2 9/2012 Sutherland
8,297,491 B2 10/2012 Kwok et al.
8,302,809 B1 11/2012 Bogdziewicz, III et al.
8,308,023 B2 11/2012 Gelardi et al.

(56) References Cited

U.S. PATENT DOCUMENTS

| | | | |
|---|---|---|---|
| 8,317,671 | B1 | 11/2012 | Zoeckler |
| 8,322,183 | B2 | 12/2012 | Myers et al. |
| 8,328,492 | B2 | 12/2012 | Turner et al. |
| 8,336,713 | B2 | 12/2012 | Poitevin |
| 8,348,051 | B2 | 1/2013 | Furey |
| 8,348,142 | B2 | 1/2013 | Smalley |
| 8,365,658 | B2 | 2/2013 | Ouchi |
| 8,371,445 | B2 | 2/2013 | Seabaugh et al. |
| 8,371,449 | B2 | 2/2013 | Berry et al. |
| 8,376,214 | B2 | 2/2013 | Spivey, Sr. et al. |
| 8,381,929 | B2 | 2/2013 | Kellerer et al. |
| 8,387,855 | B2 | 3/2013 | Brand |
| 8,393,469 | B2 | 3/2013 | Aldridge et al. |
| 8,408,412 | B2 | 4/2013 | Hong |
| 8,408,419 | B2 | 4/2013 | Rippl et al. |
| 8,413,805 | B2 | 4/2013 | Bray et al. |
| 8,439,194 | B2 | 5/2013 | Spivey |
| 8,439,198 | B2 | 5/2013 | Hines |
| 8,444,046 | B2 | 5/2013 | Debusk et al. |
| 8,459,088 | B2 | 6/2013 | Coates |
| 8,459,190 | B2 | 6/2013 | Erdie |
| 8,469,259 | B2 | 6/2013 | Clement et al. |
| 8,480,035 | B2 | 7/2013 | Goddard et al. |
| 8,490,858 | B2 | 7/2013 | Timbrook et al. |
| 8,505,716 | B2 | 8/2013 | Van Liempd |
| 8,511,463 | B2 | 8/2013 | Brand |
| 8,511,467 | B2 | 8/2013 | Sorrentino et al. |
| D689,694 | S | 9/2013 | Barth |
| 8,528,807 | B2 | 9/2013 | Kaneko |
| 8,540,094 | B2 | 9/2013 | Riedl |
| 8,540,111 | B2 | 9/2013 | Middleton et al. |
| 8,550,035 | B2 | 10/2013 | Moreno et al. |
| 8,550,241 | B2 | 10/2013 | Holford |
| 8,555,692 | B2 | 10/2013 | Myers et al. |
| 8,556,071 | B2 | 10/2013 | Holloway et al. |
| 8,556,124 | B2 | 10/2013 | Edwards |
| 8,579,184 | B2 | 11/2013 | Pettersson et al. |
| 8,602,292 | B2 | 12/2013 | Brand |
| 8,607,974 | B2 | 12/2013 | De The et al. |
| 8,631,971 | B2 | 1/2014 | Edwards |
| 8,646,653 | B2 | 2/2014 | Lien et al. |
| 8,651,310 | B2 | 2/2014 | Orgeldinger |
| 8,657,163 | B2 | 2/2014 | Eriksson |
| 8,661,969 | B2 | 3/2014 | Ewald et al. |
| 8,662,333 | B2 | 3/2014 | Orgeldinger |
| 8,671,730 | B2 | 3/2014 | Ytsma |
| 8,672,184 | B2 | 3/2014 | Edwards |
| 8,714,407 | B2 | 5/2014 | Frank et al. |
| 8,720,736 | B2 | 5/2014 | Boland |
| 8,720,743 | B2 | 5/2014 | Smalley et al. |
| 8,733,572 | B2 | 5/2014 | Ruiz Carmona |
| 8,733,624 | B2 | 5/2014 | Rueda |
| 8,746,483 | B2 | 6/2014 | Sierra-Gomez et al. |
| 8,746,540 | B2 | 6/2014 | Hultberg et al. |
| 8,776,415 | B2 | 7/2014 | Kawaguchi et al. |
| 8,789,403 | B2 | 7/2014 | Egerton et al. |
| 8,794,503 | B2 | 8/2014 | Burgos Agudo |
| 8,800,761 | B2 | 8/2014 | Lutzig et al. |
| 8,807,365 | B2 | 8/2014 | Orgeldinger |
| 8,807,417 | B2 | 8/2014 | Valesini Gegembauer |
| 8,807,418 | B2 | 8/2014 | Ouillette |
| 8,813,965 | B2 | 8/2014 | Cheema et al. |
| 8,820,201 | B2 | 9/2014 | Marcos et al. |
| 8,827,145 | B2 | 9/2014 | Hultberg et al. |
| 8,833,235 | B2 | 9/2014 | Fabozzi et al. |
| 8,844,334 | B2 | 9/2014 | Roeterdink |
| 8,844,798 | B2 | 9/2014 | Linkel |
| 8,851,279 | B1 | 10/2014 | Husmann |
| 8,851,323 | B2 | 10/2014 | Watson et al. |
| 8,851,362 | B2 | 10/2014 | Aksan et al. |
| 8,863,751 | B2 | 10/2014 | Demmer et al. |
| 8,863,951 | B2 | 10/2014 | Erickson et al. |
| 8,863,952 | B2 | 10/2014 | Bates et al. |
| 8,869,979 | B2 | 10/2014 | Smalley |
| 8,875,878 | B2 | 11/2014 | Young |
| 8,875,924 | B2 | 11/2014 | Orgeldinger |
| 8,875,982 | B2 | 11/2014 | Quadrelli |
| 8,887,906 | B2 | 11/2014 | Holford |
| 8,893,955 | B2 | 11/2014 | Clark et al. |
| 8,899,418 | B2 | 12/2014 | Francis et al. |
| 8,915,365 | B2 | 12/2014 | Fath et al. |
| 8,936,149 | B2 | 1/2015 | Smalley |
| 8,960,527 | B2 | 2/2015 | Hui |
| D724,440 | S | 3/2015 | Ulstad et al. |
| 8,966,869 | B2 | 3/2015 | Hundeloh et al. |
| 8,967,380 | B2 | 3/2015 | Moncrief et al. |
| 9,016,492 | B2 | 4/2015 | Orgeldinger |
| 9,027,780 | B2 | 5/2015 | Attard |
| 9,033,210 | B2 | 5/2015 | Kastanek |
| 9,033,211 | B2 | 5/2015 | Zanini |
| 9,038,847 | B2 | 5/2015 | Hewitt et al. |
| 9,044,082 | B2 | 6/2015 | Kusuma et al. |
| 9,051,104 | B2 | 6/2015 | Heirman et al. |
| 9,061,810 | B2 | 6/2015 | Brand |
| 9,067,713 | B2 | 6/2015 | Joy |
| 9,073,663 | B2 | 7/2015 | Holley, Jr. et al. |
| 9,073,665 | B2 | 7/2015 | Sanger |
| 9,073,680 | B2 | 7/2015 | Kastanek |
| 9,078,533 | B2 | 7/2015 | Hession |
| 9,079,239 | B2 | 7/2015 | Kojima et al. |
| 9,085,026 | B2 | 7/2015 | Mejia-Quinchia et al. |
| 9,090,390 | B2 | 7/2015 | Walling et al. |
| 9,096,345 | B2 | 8/2015 | Bogdziewcz et al. |
| 9,096,780 | B2 | 8/2015 | Zerfas et al. |
| 9,114,451 | B2 | 8/2015 | Chasteen et al. |
| 9,120,589 | B2 | 9/2015 | Hanan |
| 9,126,718 | B2 | 9/2015 | Lewis |
| 9,132,612 | B2 | 9/2015 | Bohrer |
| 9,132,936 | B2 | 9/2015 | Kohler |
| 9,132,974 | B2 | 9/2015 | Savage et al. |
| 9,139,346 | B2 | 9/2015 | Doyle |
| 9,162,564 | B2 | 10/2015 | Sakamoto et al. |
| 9,169,037 | B2 | 10/2015 | Pinkstone |
| 9,169,039 | B2 | 10/2015 | Freeman |
| 9,187,204 | B2 | 11/2015 | Mathieu et al. |
| 9,192,977 | B2 | 11/2015 | Widitora et al. |
| 9,199,774 | B2 | 12/2015 | Smalley et al. |
| 9,227,750 | B2 | 1/2016 | Franic |
| 9,227,751 | B2 | 1/2016 | Scrimger |
| 9,233,515 | B2 | 1/2016 | Cook et al. |
| 9,238,531 | B2 | 1/2016 | Himmelsbach et al. |
| 9,248,423 | B2 | 2/2016 | Cerasani |
| 9,265,287 | B2 | 2/2016 | Sims et al. |
| 9,272,819 | B1 | 3/2016 | Zabaleta et al. |
| 9,290,291 | B2 | 3/2016 | Hamdoun et al. |
| 9,302,812 | B2 | 4/2016 | Rees et al. |
| 9,309,023 | B2 | 4/2016 | Hubbard, Jr. et al. |
| 9,321,553 | B1 | 4/2016 | Spivey, Sr. et al. |
| D755,637 | S | 5/2016 | Wetton et al. |
| 9,327,338 | B2 | 5/2016 | Boysel et al. |
| 9,327,857 | B2 | 5/2016 | Scaliti et al. |
| 9,327,862 | B2 | 5/2016 | Barbieri et al. |
| 9,327,867 | B2 | 5/2016 | Stanley et al. |
| 9,334,078 | B2 | 5/2016 | Riley et al. |
| 9,334,079 | B2 | 5/2016 | Lindstrom et al. |
| 9,340,347 | B2 | 5/2016 | Holford |
| 9,346,234 | B2 | 5/2016 | Hajek et al. |
| 9,346,582 | B2 | 5/2016 | Pinkstone |
| 9,352,890 | B2 | 5/2016 | Alexander et al. |
| 9,359,106 | B2 | 6/2016 | Bogdziewicz, III et al. |
| 9,371,151 | B2 | 6/2016 | Nadeau |
| 9,382,040 | B2 | 7/2016 | Huang |
| 9,386,871 | B2 | 7/2016 | Domit |
| 9,387,530 | B2 | 7/2016 | Fowler et al. |
| 9,387,968 | B2 | 7/2016 | Zammit et al. |
| 9,394,093 | B2 | 7/2016 | Alexander et al. |
| 9,394,094 | B2 | 7/2016 | Holley, Jr. et al. |
| 9,394,154 | B2 | 7/2016 | Connerat et al. |
| 9,403,639 | B2 | 8/2016 | Bleile et al. |
| 9,409,224 | B2 | 8/2016 | Roeterdink |
| 9,415,278 | B2 | 8/2016 | Kabeshita |
| 9,415,893 | B2 | 8/2016 | Wintermute et al. |
| 9,415,915 | B2 | 8/2016 | Spivey, Sr. et al. |
| 9,434,124 | B2 | 9/2016 | Belko et al. |

(56) References Cited

U.S. PATENT DOCUMENTS 9,434,520 B2 9/2016 Bates
9,452,860 B2 9/2016 Mehta
9,452,874 B2 9/2016 Harrelson
9,463,896 B2 10/2016 Fitzwater
9,475,606 B2 10/2016 Ball et al.
9,480,322 B2 11/2016 Mortis Simons
9,481,486 B2 11/2016 Nameth et al.
9,487,320 B2 11/2016 Holley, Jr.
9,487,324 B2 11/2016 Benko et al.
9,499,296 B2 11/2016 Mills et al.
9,499,306 B2 11/2016 Miller et al.
9,501,956 B2 11/2016 Fluharty
9,505,186 B2 11/2016 Yang
9,505,513 B2 11/2016 Wolters et al.
9,505,518 B2 11/2016 Mills et al.
9,511,411 B2 12/2016 Tielbeke et al.
9,511,894 B2 12/2016 Wilson et al.
9,512,524 B2 12/2016 Riesop
9,517,498 B2 12/2016 Siles et al.
9,533,791 B2 1/2017 Fath
9,540,137 B2 1/2017 Forrest et al.
9,540,165 B2 1/2017 Kastha et al.
9,546,017 B2 1/2017 Li
9,555,459 B2 1/2017 Monro et al.
9,555,948 B2 1/2017 Nemeth et al.
9,557,209 B2 1/2017 Savage et al.
9,567,131 B2 2/2017 Riva
9,580,203 B2 2/2017 Frank
9,592,942 B2 3/2017 Walling
9,598,202 B2 3/2017 Oliveira et al.
9,598,214 B2 3/2017 Holley, Jr.
9,604,767 B2 3/2017 Ramsuer
9,604,768 B2 3/2017 Ramsuer et al.
9,611,065 B2 4/2017 Franic
9,623,473 B2 4/2017 Friedrich et al.
9,623,996 B2 4/2017 Casale et al.
9,630,739 B2 4/2017 McMahon et al.
9,637,265 B2 5/2017 Kim
9,637,296 B1 5/2017 Corvisier
9,656,776 B2 5/2017 Sloat et al.
9,656,789 B2 5/2017 Requena
9,659,426 B2 5/2017 Bauer
9,663,282 B2 5/2017 Vogt et al.
9,666,230 B2 5/2017 Rossiter
9,682,793 B2 6/2017 Magnusson et al.
9,688,427 B2 6/2017 Melrose
9,694,935 B2 7/2017 Scott
9,700,163 B2 7/2017 Kobayashi
9,700,929 B2 7/2017 Fedusa et al.
9,701,444 B2 7/2017 Gallagher
9,707,615 B2 7/2017 Dick et al.
9,708,112 B2 7/2017 Sutherland et al.
9,714,134 B2 7/2017 Tacchi et al.
9,718,110 B2 8/2017 Butcher et al.
9,718,246 B2 8/2017 Holley, Jr. et al.
9,725,202 B2 8/2017 Minnette et al.
9,738,413 B2 8/2017 Humphrey et al.
9,751,283 B2 9/2017 Yamanaka et al.
9,758,275 B2 9/2017 Fitzwater et al.
9,771,493 B2 9/2017 Riesop
9,775,469 B2 10/2017 Rizzo
9,790,013 B2 10/2017 Loftin et al.
9,796,498 B2 10/2017 Wintermute et al.
9,796,525 B2 10/2017 Orgeldinger
9,809,363 B2 11/2017 Glinert et al.
9,834,328 B2 12/2017 Madsen
9,845,173 B2 12/2017 Herman
9,849,500 B2 12/2017 Presset et al.
9,849,501 B2 12/2017 Adams et al.
9,861,551 B2 1/2018 Taylor
9,868,582 B2 1/2018 Gilpatrick et al.
9,868,587 B2 1/2018 Martini et al.
9,873,539 B2 1/2018 Yamanaka et al.
9,873,540 B2 1/2018 Skinner
9,878,365 B2 1/2018 Caylor et al.
9,878,827 B2 1/2018 Exner et al.
9,889,370 B2 2/2018 Shigeta
9,894,886 B2 2/2018 Suh
9,895,737 B2 2/2018 Caunter et al.
9,901,222 B2 2/2018 Wilson et al.
9,901,972 B2 2/2018 Rayburn
9,919,855 B2 3/2018 Vogt et al.
9,938,043 B2 4/2018 Chasteen et al.
9,938,299 B2 4/2018 Selnick et al.
9,943,899 B2 4/2018 Pilon et al.
9,944,427 B2 4/2018 Phung
10,010,095 B2 7/2018 Vaccarella
2002/0033393 A1 3/2002 Fux
2002/0033397 A1 3/2002 Henson
2002/0170868 A1 11/2002 Morgan
2003/0121924 A1 7/2003 Stodd
2003/0166368 A1 9/2003 Bushman et al.
2003/0192907 A1 10/2003 Bates
2004/0137202 A1 7/2004 Hamilton et al.
2004/0226267 A1 11/2004 Mansuino
2004/0247751 A1 12/2004 Vangertruyden
2005/0208186 A1 9/2005 Kirkland
2006/0062874 A1 3/2006 Sinichko et al.
2006/0140746 A1 6/2006 Koon
2006/0162292 A1 7/2006 Liempd Van
2006/0191929 A1 8/2006 Berg, Jr. et al.
2006/0191985 A1 8/2006 Norcom
2006/0231599 A1 10/2006 Matthews
2006/0237454 A1 10/2006 Clarke
2006/0273098 A1* 12/2006 Emalfarb ..... A01G 9/02 220/565
2006/0278559 A1 12/2006 Hamblin et al.
2007/0017915 A1 1/2007 Weder et al.
2007/0017962 A1 1/2007 Russ
2007/0039970 A1 2/2007 Ivey
2007/0152458 A1 7/2007 Guidetti
2007/0187273 A1 8/2007 Grosskopf
2008/0041752 A1 2/2008 Schormair
2008/0054060 A1 3/2008 Greenfield
2008/0116085 A1 5/2008 Artis et al.
2008/0179204 A1 7/2008 Lutzig
2008/0223912 A1 9/2008 Ayats Ardite et al.
2008/0237326 A1 10/2008 Bates
2008/0305209 A1* 12/2008 Mattei ..... A23C 19/0684 426/396
2009/0084787 A1 4/2009 Ikenoya
2009/0211941 A1 6/2009 Maroofan et al.
2009/0184158 A1 7/2009 Lutzig et al.
2009/0250370 A1 10/2009 Whitchurch
2009/0283581 A1 11/2009 Aldridge et al.
2010/0126895 A1 5/2010 Smith et al.
2010/0155402 A1 6/2010 Maroofian et al.
2010/0187150 A1 7/2010 Dijkstra et al.
2010/0307933 A1 12/2010 Nicholas
2010/0310731 A1 12/2010 Manning et al.
2010/0314284 A1 12/2010 Truesdale
2011/0132791 A1 6/2011 Dijkstra et al.
2011/0143070 A1 6/2011 Toff et al.
2011/0186461 A1 8/2011 Poitevin
2011/0294638 A1 12/2011 Tosevski
2012/0018502 A1 1/2012 Walling et al.
2012/0024940 A1 2/2012 Lakakis
2012/0048758 A1 3/2012 Arnold
2012/0091021 A1 4/2012 Smalley
2012/0091149 A1 4/2012 Pedmo
2012/0125796 A1 5/2012 Falcon
2012/0152783 A1 6/2012 Cheema et al.
2012/0152784 A1 6/2012 Nukuto et al.
2012/0199640 A1 8/2012 Thorne et al.
2012/0228370 A1 9/2012 Faulon et al.
2012/0247995 A1 10/2012 Charles
2012/0280026 A1 11/2012 Faulon et al.
2012/0292328 A1 11/2012 Orgeldinger et al.
2012/0294988 A1 11/2012 Munro et al.
2013/0001120 A1 1/2013 Yaron et al.
2013/0074401 A1 3/2013 Forno
2013/0126524 A1 5/2013 Ueda et al.
2013/0139700 A1 6/2013 Fabozzi et al.
2013/0189393 A1 7/2013 Traldi

(56) References Cited

U.S. PATENT DOCUMENTS

2013/0200100 A1 8/2013 Hanssen et al.
2013/0202750 A1 8/2013 Radley et al.
2013/0213855 A1 8/2013 Orgeldinger et al.
2013/0277418 A1 10/2013 Van Berlo et al.
2013/0291612 A1 11/2013 Dick et al.
2013/0319886 A1 12/2013 Ledermann
2013/0320006 A1 12/2013 Orgeldinger
2013/0327821 A1 12/2013 Zwaga et al.
2014/0144974 A1 5/2014 Boots et al.
2014/0170348 A1 6/2014 Yamazaki et al.
2014/0175025 A1 6/2014 Parker
2014/0230371 A1 8/2014 Taylor et al.
2014/0237897 A1 8/2014 Lotvak et al.
2014/0242230 A1 8/2014 Iwegbu
2014/0252008 A1 9/2014 DeLeon
2014/0252011 A1 9/2014 Dunwoody
2014/0253718 A1 9/2014 Leitzen et al.
2014/0262871 A1 9/2014 Fath
2014/0262895 A1 9/2014 Maceira
2014/0263372 A1 9/2014 Brewer et al.
2014/0274552 A1 9/2014 Frink et al.
2014/0291180 A1 10/2014 Lutzig
2014/0305935 A1 10/2014 Decraim
2014/0312106 A1 10/2014 Jang
2014/0314916 A1 10/2014 Anderie et al.
2014/0353307 A1 12/2014 Pinkstone
2014/0356489 A1 12/2014 Pohl
2015/0004551 A1 1/2015 Ruehl
2015/0014201 A1 1/2015 Moore
2015/0014405 A1 1/2015 Robertson et al.
2015/0020364 A1 1/2015 Bonfoey
2015/0021317 A1 1/2015 Sharkey et al.
2015/0024094 A1 1/2015 Keller et al.
2015/0027917 A1 1/2015 Goddard
2015/0028045 A1 1/2015 Oakes
2015/0034707 A1 2/2015 Mello et al.
2015/0034709 A1 2/2015 Spivey, Sr. et al.
2015/0045551 A1 2/2015 Yoshinaga et al.
2015/0056339 A1 2/2015 Vaes
2015/0083642 A1 3/2015 Dellimore et al.
2015/0096644 A1 4/2015 Lee et al.
2015/0096921 A1 4/2015 Hyatt
2015/0096978 A1 4/2015 Henderson et al.
2015/0101380 A1 4/2015 Cook
2015/0108153 A1 4/2015 Faber
2015/0108208 A1 4/2015 Nash et al.
2015/0113921 A1 4/2015 Billings
2015/0115024 A1 4/2015 Finol et al.
2015/0122676 A1 5/2015 Brugger et al.
2015/0128529 A1 5/2015 Lopez-Arostegui Saenz
2015/0136764 A1 5/2015 Dropsy et al.
2015/0136796 A1 5/2015 Muehlhauser
2015/0144688 A1 5/2015 Bates et al.
2015/0151350 A1 6/2015 Carstens et al.
2015/0166215 A1 6/2015 Dirico
2015/0166257 A1 6/2015 Trombetta
2015/0191287 A1 7/2015 L'Heureux et al.
2015/0197386 A1 7/2015 Chang
2015/0203239 A1 7/2015 Iwegbu
2015/0210461 A1 7/2015 Morris et al.
2015/0225107 A1 8/2015 Ross et al.
2015/0225158 A1 8/2015 Lyzenga et al.
2015/0257407 A1 9/2015 Glazier et al.
2015/0259093 A1 9/2015 Boersma et al.
2015/0259109 A1 9/2015 Vetten et al.
2015/0274409 A1 10/2015 Nachbagauer et al.
2015/0283597 A1 10/2015 Monro
2015/0284134 A1 10/2015 Kreutzer et al.
2015/0284138 A1 10/2015 Lane et al.
2015/0284158 A1 10/2015 Yako
2015/0284165 A1 10/2015 Oeyen
2015/0298852 A1 10/2015 Higareda et al.
2015/0298884 A1 10/2015 Zhao et al.
2015/0313388 A1 11/2015 Kane
2015/0314949 A1 11/2015 Bechtel et al.
2015/0321832 A1 11/2015 Bankowski
2015/0329277 A1 11/2015 Dijkstra
2015/0343221 A1 12/2015 Mashiach
2015/0360820 A1 12/2015 Akutsu et al.
2015/0366386 A1 12/2015 D'Amato
2015/0367614 A1 12/2015 Sasaki et al.
2015/0368031 A1 12/2015 Wetton et al.
2015/0374178 A1 12/2015 Rene Porte
2015/0375484 A1 12/2015 Johansson
2016/0001948 A1 1/2016 Collins et al.
2016/0007807 A1 1/2016 D'Amato
2016/0009444 A1 1/2016 Nakagawa et al.
2016/0009446 A1 1/2016 Huizingh et al.
2016/0010172 A1 1/2016 Holleck et al.
2016/0016223 A1 1/2016 Wilkinson et al.
2016/0016685 A1 1/2016 Bauernfeind
2016/0016687 A1 1/2016 Ramsey et al.
2016/0023823 A1 1/2016 Barron
2016/0031634 A1 2/2016 Hodges et al.
2016/0038992 A1 2/2016 Arthur et al.
2016/0039600 A1 2/2016 Wilcox et al.
2016/0067644 A1 3/2016 Scaife
2016/0068313 A1 3/2016 Hart
2016/0075466 A1 3/2016 Wiley
2016/0075468 A1 3/2016 Kobayashi et al.
2016/0083166 A1 3/2016 Heyn
2016/0089829 A1 3/2016 Derkman et al.
2016/0090230 A1 3/2016 Dong
2016/0102414 A1 4/2016 Tani et al.
2016/0106248 A1 4/2016 Petersen et al.
2016/0107772 A1 4/2016 Eto et al.
2016/0114913 A1 4/2016 Eto et al.
2016/0122107 A1 5/2016 Pansegrouw
2016/0130060 A1 5/2016 Ball
2016/0130074 A1 5/2016 Kastha et al.
2016/0137330 A1 5/2016 Sobiech
2016/0137350 A1 5/2016 Hoekstra et al.
2016/0145462 A1 5/2016 Kawamura et al.
2016/0152394 A1 6/2016 Ghini et al.
2016/0152395 A1 6/2016 Pansegrouw
2016/0152406 A1 6/2016 Lloyd et al.
2016/0159544 A1 6/2016 Ghini et al.
2016/0167828 A1 6/2016 Ghini et al.
2016/0176554 A1 6/2016 Blake et al.
2016/0176570 A1 6/2016 Collier et al.
2016/0176571 A1 6/2016 Ruge
2016/0176617 A1 6/2016 Bolognia et al.
2016/0176621 A1 6/2016 Sytsma
2016/0193647 A1 7/2016 Holstine et al.
2016/0193800 A1 7/2016 Skinner
2016/0195118 A1 7/2016 Munch-Fals et al.
2016/0198892 A1 7/2016 Montagut Sala et al.
2016/0200485 A1 7/2016 Quinones et al.
2016/0214779 A1 7/2016 Riva
2016/0215801 A1 7/2016 Munch-Fals
2016/0221064 A1 8/2016 Namekawa et al.
2016/0221708 A1 8/2016 Ojima et al.
2016/0251105 A1 9/2016 Robinson et al.
2016/0256910 A1 9/2016 Niec et al.
2016/0257486 A1 9/2016 Kuiper et al.
2016/0264331 A1 9/2016 Gatteschi
2016/0272408 A1 9/2016 Knudsen
2016/0288947 A1 10/2016 Giraud et al.
2016/0302626 A1 10/2016 D'Hiet et al.
2016/0311578 A1 10/2016 Ramsuer
2016/0315037 A1 10/2016 Kadoguchi et al.
2016/0318217 A1 11/2016 Borghi et al.
2016/0318649 A1 11/2016 Bundy et al.
2016/0325471 A1 11/2016 Martini et al.
2016/0325533 A1 11/2016 Scharfenort et al.
2016/0325672 A1 11/2016 Barbieri et al.
2016/0325878 A1 11/2016 Bjork et al.
2016/0325879 A1 11/2016 Martini et al.
2016/0325913 A1 11/2016 Kim et al.
2016/0325919 A1 11/2016 Dijkstra
2016/0331174 A1 11/2016 Allemand et al.
2016/0332795 A1 11/2016 Mainz
2016/0339537 A1 11/2016 Wu et al.
2016/0340073 A1 11/2016 Babington

(56) References Cited

U.S. PATENT DOCUMENTS

| | | | |
|---|---|---|---|
| 2016/0340099 | A1 | 11/2016 | Scharfenort et al. |
| 2016/0347497 | A1 | 12/2016 | Novotny et al. |
| 2016/0355312 | A1 | 12/2016 | Paternina Leon et al. |
| 2016/0355320 | A1 | 12/2016 | Maier-Eschenlohr et al. |
| 2016/0355647 | A1 | 12/2016 | Ueda et al. |
| 2016/0361750 | A1 | 12/2016 | Lee |
| 2016/0367714 | A1 | 12/2016 | Fileccia et al. |
| 2016/0368701 | A1 | 12/2016 | Stoll et al. |
| 2017/0001230 | A1 | 1/2017 | Berrux et al. |
| 2017/0001786 | A1 | 1/2017 | Wallace |
| 2017/0002227 | A1 | 1/2017 | Gibanel et al. |
| 2017/0008207 | A1 | 1/2017 | Tamarindo |
| 2017/0015462 | A1 | 1/2017 | Roth et al. |
| 2017/0015480 | A1 | 1/2017 | Slack et al. |
| 2017/0023665 | A1 | 2/2017 | Ferreira Da Rocha Felix et al. |
| 2017/0036846 | A1 | 2/2017 | Bressan et al. |
| 2017/0043901 | A1 | 2/2017 | Ogawa et al. |
| 2017/0043911 | A1 | 2/2017 | Kinouchi et al. |
| 2017/0057688 | A1 | 3/2017 | Patwardhan et al. |
| 2017/0057721 | A1 | 3/2017 | Lee et al. |
| 2017/0066579 | A1 | 3/2017 | Zillges |
| 2017/0087810 | A1 | 3/2017 | Schuman et al. |
| 2017/0105707 | A1 | 4/2017 | Senior et al. |
| 2017/0129653 | A1 | 5/2017 | Poitevin |
| 2017/0217651 | A2 | 8/2017 | Stirn |
| 2017/0361972 | A1 | 12/2017 | Herman et al. |
| 2017/0368593 | A1 | 12/2017 | Frishman |
| 2018/0002095 | A1 | 1/2018 | McDonald et al. |
| 2018/0079585 | A1 | 3/2018 | Berthault |
| 2018/0177208 | A1 | 6/2018 | Vaccarella et al. |
| 2018/0201431 | A1 | 7/2018 | Vincent |

FOREIGN PATENT DOCUMENTS

| | | | |
|---|---|---|---|
| AU | 726335 | B2 | 11/1997 |
| AU | 745584 | B2 | 5/1998 |
| AU | 729565 | B2 | 5/1999 |
| AU | 737716 | B2 | 2/2000 |
| AU | 763517 | B2 | 2/2000 |
| AU | 760345 | B2 | 7/2000 |
| AU | 200013569 | A1 | 8/2000 |
| AU | 777628 | B2 | 9/2000 |
| AU | 737840 | B1 | 8/2001 |
| AU | 770132 | B2 | 1/2002 |
| AU | 769925 | C | 2/2002 |
| AU | 2001279962 | B2 | 3/2002 |
| AU | 2001295245 | B2 | 4/2002 |
| AU | 782121 | B2 | 5/2002 |
| AU | 2001255628 | B2 | 11/2002 |
| AU | 756446 | B1 | 1/2003 |
| AU | 2002301632 | B2 | 6/2003 |
| AU | 2002351876 | B2 | 7/2003 |
| AU | 785244 | B2 | 10/2003 |
| AU | 2003218219 | B2 | 10/2003 |
| AU | 2003227159 | B1 | 5/2004 |
| AU | 2004203521 | B2 | 8/2004 |
| AU | 2004200559 | B2 | 9/2004 |
| AU | 2004228356 | B2 | 10/2004 |
| AU | 2004218733 | B2 | 11/2004 |
| AU | 2004222799 | B2 | 11/2004 |
| AU | 2004238398 | B2 | 11/2004 |
| AU | 2004277288 | B2 | 4/2005 |
| AU | 2004235603 | B2 | 6/2005 |
| AU | 2005200235 | B2 | 8/2005 |
| AU | 2005202709 | B2 | 2/2006 |
| AU | 2005237170 | B2 | 6/2006 |
| AU | 2005237171 | B2 | 6/2006 |
| AU | 2006258730 | B2 | 12/2006 |
| AU | 2006268011 | B2 | 1/2007 |
| AU | 2006273776 | B2 | 2/2007 |
| AU | 2006235890 | B2 | 5/2007 |
| AU | 2007203600 | C1 | 8/2007 |
| AU | 2007200952 | B2 | 9/2007 |
| AU | 2007214384 | B2 | 9/2007 |
| AU | 2007201523 | B2 | 10/2007 |
| AU | 2007221738 | B2 | 10/2007 |
| AU | 2007203066 | B2 | 1/2008 |
| AU | 2007343169 | B2 | 7/2008 |
| AU | 2008100779 | A4 | 10/2008 |
| AU | 2008252897 | B2 | 11/2008 |
| AU | 2008221543 | B2 | 3/2009 |
| AU | 2009100102 | A4 | 3/2009 |
| AU | 2009100414 | A4 | 7/2009 |
| AU | 2009100715 | A4 | 8/2009 |
| AU | 2009100873 | A4 | 10/2009 |
| AU | 2009101143 | A4 | 12/2009 |
| AU | 2009101204 | A4 | 12/2009 |
| AU | 2009300103 | B2 | 4/2010 |
| AU | 2010100275 | A4 | 4/2010 |
| AU | 2009322088 | B2 | 6/2010 |
| AU | 2010100414 | B4 | 6/2010 |
| AU | 2009341464 | B2 | 9/2010 |
| AU | 2010200687 | A1 | 9/2010 |
| AU | 2010101444 | A4 | 2/2011 |
| AU | 2011100699 | A4 | 7/2011 |
| AU | 2011100749 | A4 | 8/2011 |
| AU | 2011204938 | B2 | 8/2011 |
| AU | 2010202016 | A1 | 12/2011 |
| AU | 2011101312 | A4 | 12/2011 |
| AU | 2011203304 | A1 | 2/2012 |
| AU | 2012100016 | A4 | 2/2012 |
| AU | 2011304564 | B2 | 3/2012 |
| AU | 2012100058 | A4 | 3/2012 |
| AU | 2012100081 | A4 | 3/2012 |
| AU | 2012100248 | A4 | 4/2012 |
| AU | 2012101088 | A4 | 8/2012 |
| AU | 2012200793 | A1 | 8/2012 |
| AU | 2012225203 | B2 | 9/2012 |
| AU | 2012201957 | A1 | 11/2012 |
| AU | 2012258335 | B2 | 12/2012 |
| AU | 2011203201 | A1 | 1/2013 |
| AU | 2011203534 | A1 | 1/2013 |
| AU | 2012203518 | A1 | 1/2013 |
| AU | 2011204892 | A1 | 2/2013 |
| AU | 2012211400 | A1 | 2/2013 |
| AU | 2013201952 | A1 | 4/2013 |
| AU | 2013205527 | A1 | 5/2013 |
| AU | 2012101891 | A4 | 6/2013 |
| AU | 2013100619 | B4 | 6/2013 |
| AU | 2013200014 | A1 | 7/2013 |
| AU | 2013101114 | A4 | 9/2013 |
| AU | 2013101227 | A4 | 10/2013 |
| AU | 2013205013 | A1 | 10/2013 |
| AU | 2013101358 | A4 | 11/2013 |
| AU | 2013204167 | A1 | 11/2013 |
| AU | 2013206121 | A1 | 12/2013 |
| AU | 2013260704 | B2 | 12/2013 |
| AU | 2012203731 | A1 | 1/2014 |
| AU | 2013294680 | B2 | 1/2014 |
| AU | 2014100103 | A4 | 3/2014 |
| AU | 2014100174 | A4 | 3/2014 |
| AU | 2014100439 | A4 | 6/2014 |
| AU | 2014202566 | A1 | 6/2014 |
| AU | 2013200123 | B2 | 7/2014 |
| AU | 2013202178 | A1 | 8/2014 |
| AU | 2014208248 | A1 | 8/2014 |
| AU | 2014250720 | A1 | 10/2014 |
| AU | 2013206023 | A1 | 12/2014 |
| AU | 2014224086 | A1 | 3/2015 |
| AU | 2015100511 | A4 | 5/2015 |
| AU | 2015101026 | A4 | 9/2015 |
| AU | 2015201241 | A1 | 10/2015 |
| BE | 700309 | A | 12/1967 |
| CA | 68833 | A | 9/1900 |
| CA | 73012 | A | 9/1901 |
| CA | 74071 | A | 12/1901 |
| CA | 80184 | A | 4/1903 |
| CA | 92546 | A | 4/1905 |
| CA | 106704 | A | 7/1907 |
| CA | 106705 | A | 7/1907 |
| CA | 107756 | A | 10/1907 |
| CA | 119009 | A | 6/1909 |
| CA | 232843 | A | 7/1923 |
| CA | 2209287 | A1 | 7/1996 |

(56) References Cited

FOREIGN PATENT DOCUMENTS

| | | | |
|---|---|---|---|
| CA | 2283774 | A1 | 9/1999 |
| CA | 2370696 | A1 | 10/2001 |
| CA | 2373094 | A1 | 11/2001 |
| CA | 2374569 | A1 | 12/2001 |
| CA | 2420078 | A1 | 2/2003 |
| CA | 101348 | | 1/2004 |
| CA | 2944101 | A1 | 12/2008 |
| CA | 2795773 | A1 | 6/2013 |
| CN | 2185250 | Y | 12/1994 |
| CN | 1931680 | A | 3/2007 |
| CN | 201334201 | Y | 10/2009 |
| CN | 201424243 | Y | 3/2010 |
| CN | 201520492 | U | 7/2010 |
| CN | 201745946 | U | 2/2011 |
| CN | 203359069 | U | 12/2013 |
| DE | 7629299 | U1 | 2/1977 |
| DE | 4324070 | A1 | 2/1994 |
| DE | 20001480 | U1 | 7/2000 |
| DE | 69925190 | T2 | 10/2005 |
| DE | 202005020050 | U1 | 4/2006 |
| EM | 0001551480001 | A1 | 6/2004 |
| EM | 0001551480002 | A1 | 6/2004 |
| EM | 0001551480003 | A1 | 6/2004 |
| EM | 0001551480005 | A1 | 6/2004 |
| EM | 0001551480006 | A1 | 6/2004 |
| EM | 0002517230001 | A1 | 2/2005 |
| EM | 0002776030001 | A1 | 3/2005 |
| EM | 0002776030008 | A1 | 3/2005 |
| EM | 0003059740001 | A1 | 5/2005 |
| EM | 0003059740002 | A1 | 5/2005 |
| EM | 0003276630002 | A1 | 6/2005 |
| EM | 0003276630004 | A1 | 6/2005 |
| EM | 0003276630005 | A1 | 6/2005 |
| EM | 0002554680010 | A1 | 12/2005 |
| EM | 0006135340001 | A1 | 11/2006 |
| EM | 0006135340002 | A1 | 11/2006 |
| EM | 0006135340003 | A1 | 11/2006 |
| EM | 0006135340005 | A1 | 11/2006 |
| EM | 0006135340006 | A1 | 11/2006 |
| EM | 0006135340007 | A1 | 11/2006 |
| EM | 0006467400001 | A1 | 1/2007 |
| EM | 0006467400002 | A1 | 1/2007 |
| EM | 0006672900001 | A1 | 2/2007 |
| EM | 0007113460001 | A1 | 6/2007 |
| EM | 0007113460002 | A1 | 6/2007 |
| EM | 0007113460003 | A1 | 6/2007 |
| EM | 0007113460004 | A1 | 6/2007 |
| EM | 0007113460005 | A1 | 6/2007 |
| EM | 0007113460006 | A1 | 6/2007 |
| EM | 0007113460007 | A1 | 6/2007 |
| EM | 0007113460008 | A1 | 6/2007 |
| EM | 0007113460009 | A1 | 6/2007 |
| EM | 0007113460010 | A1 | 6/2007 |
| EM | 0007213780001 | A1 | 6/2007 |
| EM | 000721543001 | A1 | 7/2007 |
| EM | 0007489180001 | A1 | 7/2007 |
| EM | 0007556810002 | A1 | 7/2007 |
| EM | 0007677280001 | A1 | 8/2007 |
| EM | 0007840040001 | A1 | 9/2007 |
| EM | 0008051220001 | A1 | 10/2007 |
| EM | 0008051220003 | A1 | 10/2007 |
| EM | 0007855220001 | A1 | 11/2007 |
| EM | 0008631960001 | A1 | 2/2008 |
| EM | 0007988300004 | A1 | 3/2008 |
| EM | 0008387270001 | A1 | 3/2008 |
| EM | 0009128600001 | A1 | 5/2008 |
| EM | 0009820200004 | A1 | 8/2008 |
| EM | 0009857340010 | A1 | 8/2008 |
| EM | 0009857340014 | A1 | 8/2008 |
| EM | 0009857340015 | A1 | 8/2008 |
| EM | 0007988300017 | A1 | 10/2008 |
| EM | 0010785880002 | A1 | 2/2009 |
| EM | 0010785880003 | A1 | 2/2009 |
| EM | 0010551070001 | A1 | 3/2009 |
| EM | 0010618730001 | A1 | 3/2009 |
| EM | 0010618730002 | A1 | 3/2009 |
| EM | 0010822910001 | A1 | 3/2009 |
| EM | 0011301570011 | A1 | 7/2009 |
| EM | 0011301570012 | A1 | 7/2009 |
| EM | 0015914620001 | A1 | 8/2009 |
| EM | 0011493890001 | A1 | 9/2009 |
| EM | 0011493890002 | A1 | 9/2009 |
| EM | 0011493890003 | A1 | 9/2009 |
| EM | 0011493890004 | A1 | 9/2009 |
| EM | 0011493890006 | A1 | 9/2009 |
| EM | 0011493890007 | A1 | 9/2009 |
| EM | 0011493890008 | A1 | 9/2009 |
| EM | 0011493890009 | A1 | 9/2009 |
| EM | 0011493970001 | A1 | 9/2009 |
| EM | 0011493970002 | A1 | 9/2009 |
| EM | 0011493970003 | A1 | 9/2009 |
| EM | 0011493970004 | A1 | 9/2009 |
| EM | 0011493970005 | A1 | 9/2009 |
| EM | 0011493970006 | A1 | 9/2009 |
| EM | 0011494050001 | A1 | 9/2009 |
| EM | 0011494050002 | A1 | 9/2009 |
| EM | 0011494050003 | A1 | 9/2009 |
| EM | 0011637110001 | A1 | 11/2009 |
| EM | 0016347340002 | A1 | 11/2009 |
| EM | 0016426610003 | A1 | 12/2009 |
| EM | 0011862410001 | A1 | 1/2010 |
| EM | 0011862410002 | A1 | 1/2010 |
| EM | 0011862330001 | A1 | 2/2010 |
| EM | 0011862330002 | A1 | 2/2010 |
| EM | 0011874050001 | A1 | 2/2010 |
| EM | 0016759920001 | A1 | 3/2010 |
| EM | 0016811310001 | A1 | 4/2010 |
| EM | 0017150950002 | A1 | 6/2010 |
| EM | 0016904470001 | A1 | 8/2010 |
| EM | 0016904470002 | A1 | 8/2010 |
| EM | 0017387580002 | A1 | 9/2010 |
| EM | 0017490290001 | A1 | 9/2010 |
| EM | 0017683180001 | A1 | 10/2010 |
| EM | 0017897360001 | A1 | 12/2010 |
| EM | 0017897360002 | A1 | 12/2010 |
| EM | 0017897360003 | A1 | 12/2010 |
| EM | 0017931330001 | A1 | 1/2011 |
| EM | 0017981330002 | A1 | 1/2011 |
| EM | 0018336250001 | A1 | 3/2011 |
| EM | 0018229090003 | A1 | 4/2011 |
| EM | 0018372790002 | A1 | 5/2011 |
| EM | 0018527240001 | A1 | 5/2011 |
| EM | 0018527240002 | A1 | 5/2011 |
| EM | 0018876210002 | A1 | 7/2011 |
| EM | 0018876210003 | A1 | 7/2011 |
| EM | 0011169410001 | A1 | 10/2011 |
| EM | 0019631250001 | A1 | 1/2012 |
| EM | 0019631250002 | A1 | 1/2012 |
| EM | 0019631250003 | A1 | 1/2012 |
| EM | 0019631250004 | A1 | 1/2012 |
| EM | 0019631250005 | A1 | 1/2012 |
| EM | 0019631250006 | A1 | 1/2012 |
| EM | 0019631250007 | A1 | 1/2012 |
| EM | 0019631250008 | A1 | 1/2012 |
| EM | 0019631900001 | A1 | 1/2012 |
| EM | 0019631900002 | A1 | 1/2012 |
| EM | 0019631900003 | A1 | 1/2012 |
| EM | 0019631900004 | A1 | 1/2012 |
| EM | 0019631900005 | A1 | 1/2012 |
| EM | 0019631900006 | A1 | 1/2012 |
| EM | 0019631900007 | A1 | 1/2012 |
| EM | 0019631900008 | A1 | 1/2012 |
| EM | 0019632160001 | A1 | 1/2012 |
| EM | 0019632160002 | A1 | 1/2012 |
| EM | 0019632160003 | A1 | 1/2012 |
| EM | 0019632160004 | A1 | 1/2012 |
| EM | 0019632160005 | A1 | 1/2012 |
| EM | 0019632160006 | A1 | 1/2012 |
| EM | 0019632160007 | A1 | 1/2012 |
| EM | 0019632160008 | A1 | 1/2012 |
| EM | 0013118150001 | A1 | 2/2012 |
| EM | 0013118150002 | A1 | 2/2012 |
| EM | 0013118150003 | A1 | 2/2012 |
| EM | 0013118150004 | A1 | 2/2012 |

(56) References Cited

FOREIGN PATENT DOCUMENTS

| | | | | | |
|---|---|---|---|---|---|
| EM | 0013118150005 | A1 | | 2/2012 | |
| EM | 0020095300001 | A1 | | 3/2012 | |
| EM | 0020406590001 | A1 | | 10/2012 | |
| EM | 0020406590002 | A1 | | 10/2012 | |
| EM | 0020406590003 | A1 | | 10/2012 | |
| EM | 0021864030001 | A1 | | 2/2013 | |
| EM | 0021864030002 | A1 | | 2/2013 | |
| EM | 0021864030004 | A1 | | 2/2013 | |
| EM | 0021864030005 | A1 | | 2/2013 | |
| EM | 0021864030006 | A1 | | 2/2013 | |
| EM | 0022203430001 | A1 | | 7/2013 | |
| EM | 0022203430002 | A1 | | 7/2013 | |
| EM | 0022203430003 | A1 | | 7/2013 | |
| EM | 0022203430004 | A1 | | 7/2013 | |
| EM | 0022203430009 | A1 | | 7/2013 | |
| EM | 0022203430010 | A1 | | 7/2013 | |
| EM | 0022203430011 | A1 | | 7/2013 | |
| EM | 0022203430012 | A1 | | 7/2013 | |
| EM | 0022203430013 | A1 | | 7/2013 | |
| EM | 0022203430014 | A1 | | 7/2013 | |
| EM | 0022203430015 | A1 | | 7/2013 | |
| EM | 0022203430016 | A1 | | 7/2013 | |
| EM | 0022203430017 | A1 | | 7/2013 | |
| EM | 0022857180001 | A1 | | 8/2013 | |
| EM | 0022857180003 | A1 | | 8/2013 | |
| EM | 0022857180005 | A1 | | 8/2013 | |
| EM | 0022857180007 | A1 | | 8/2013 | |
| EM | 0022857180009 | A1 | | 8/2013 | |
| EM | 0023071240001 | A1 | | 11/2013 | |
| EM | 0023071240002 | A1 | | 11/2013 | |
| EM | 0023071240003 | A1 | | 11/2013 | |
| EM | 0023071240004 | A1 | | 11/2013 | |
| EM | 0023071240005 | A1 | | 11/2013 | |
| EM | 0016936600002 | A1 | | 1/2014 | |
| EM | 0014042480001 | A1 | | 3/2014 | |
| EM | 0014042480002 | A1 | | 3/2014 | |
| EM | 0014042480003 | A1 | | 3/2014 | |
| EM | 0014042480004 | A1 | | 3/2014 | |
| EM | 0014042480005 | A1 | | 3/2014 | |
| EM | 0014042480006 | A1 | | 3/2014 | |
| EM | 0014042480007 | A1 | | 3/2014 | |
| EM | 0023738030001 | A1 | | 3/2014 | |
| EM | 0023738030002 | A1 | | 3/2014 | |
| EM | 0023738030003 | A1 | | 3/2014 | |
| EM | 0023738030004 | A1 | | 3/2014 | |
| EM | 0024362530001 | A1 | | 5/2014 | |
| EM | 0024362530002 | A1 | | 5/2014 | |
| EM | 0024362530003 | A1 | | 5/2014 | |
| EM | 0024691300001 | A1 | | 5/2014 | |
| EM | 0024900600001 | A1 | | 8/2014 | |
| EM | 0025014780001 | A1 | | 10/2014 | |
| EM | 0025014780002 | A1 | | 10/2014 | |
| EM | 0025014780003 | A1 | | 10/2014 | |
| EM | 0025014780004 | A1 | | 10/2014 | |
| EM | 0025014780005 | A1 | | 10/2014 | |
| EM | 0026280080001 | A1 | | 2/2015 | |
| EM | 0026280080002 | A1 | | 2/2015 | |
| EM | 0026329840001 | A1 | | 2/2015 | |
| EM | 0026901560001 | A1 | | 5/2015 | |
| EM | 002777409001 | A1 | | 10/2015 | |
| EM | 0026881560013 | A1 | | 12/2015 | |
| EM | 0026881560024 | A1 | | 12/2015 | |
| EM | 0028869290001 | A1 | | 12/2015 | |
| EM | 0028881560001 | A1 | | 12/2015 | |
| EM | 0028881560002 | A1 | | 12/2015 | |
| EM | 0028881560003 | A1 | | 12/2015 | |
| EM | 0028881560004 | A1 | | 12/2015 | |
| EM | 0028881560005 | A1 | | 12/2015 | |
| EM | 0028881560006 | A1 | | 12/2015 | |
| EM | 0028881560007 | A1 | | 12/2015 | |
| EM | 0028881560008 | A1 | | 12/2015 | |
| EM | 0028881560009 | A1 | | 12/2015 | |
| EM | 0028881560010 | A1 | | 12/2015 | |
| EM | 0028881560011 | A1 | | 12/2015 | |
| EM | 0028881560012 | A1 | | 12/2015 | |
| EM | 0028881560014 | A1 | | 12/2015 | |
| EM | 0028881560015 | A1 | | 12/2015 | |
| EM | 0028881560016 | A1 | | 12/2015 | |
| EM | 0028881560017 | A1 | | 12/2015 | |
| EM | 0028881560018 | A1 | | 12/2015 | |
| EM | 0028881560019 | A1 | | 12/2015 | |
| EM | 0028881560020 | A1 | | 12/2015 | |
| EM | 0028881560021 | A1 | | 12/2015 | |
| EM | 0028881560022 | A1 | | 12/2015 | |
| EM | 0028881560023 | A1 | | 12/2015 | |
| EM | 0030008350001 | A1 | | 2/2016 | |
| EM | 0032258530001 | A1 | | 7/2016 | |
| EM | 0033059780001 | A1 | | 9/2016 | |
| EM | 0033059780002 | A1 | | 9/2016 | |
| EM | 0033059780003 | A1 | | 9/2016 | |
| EM | 0033734220001 | A1 | | 9/2016 | |
| EM | 0034434310001 | A1 | | 11/2016 | |
| EM | 0035011880004 | A1 | | 12/2016 | |
| EM | 0014521220001 | A1 | | 1/2017 | |
| EM | 0014521220002 | A1 | | 1/2017 | |
| EM | 0034514670001 | A1 | | 1/2017 | |
| EM | 0035285610001 | A1 | | 1/2017 | |
| EM | 0035285610002 | A1 | | 1/2017 | |
| EM | 0034659620001 | A1 | | 2/2017 | |
| EM | 0035785900001 | A1 | | 2/2017 | |
| EM | 0037000460001 | A1 | | 2/2017 | |
| EM | 0037377410002 | A1 | | 2/2017 | |
| EM | 0037377410003 | A1 | | 2/2017 | |
| EM | 0037377410004 | A1 | | 2/2017 | |
| EM | 0037377410005 | A1 | | 2/2017 | |
| EM | 0037377410006 | A1 | | 2/2017 | |
| EM | 0037377410007 | A1 | | 2/2017 | |
| EM | 0037377410008 | A1 | | 2/2017 | |
| EP | 0368672 | A1 | | 5/1990 | |
| EP | 0530344 | A1 | | 3/1993 | |
| EP | 0768039 | A1 | | 4/1997 | |
| EP | 0919488 | A1 | | 6/1999 | |
| EP | 1002464 | A2 | * | 5/2000 | ..... A23G 1/207 |
| EP | 1533245 | A1 | | 5/2005 | |
| EP | 2476631 | A2 | | 7/2012 | |
| FR | 2291111 | A1 | | 6/1976 | |
| GB | 2010221 | A | * | 6/1979 | ..... B65D 11/02 |
| JP | H101180 | A | | 1/1998 | |
| JP | 2006137461 | A | | 6/2006 | |
| JP | 2006256649 | A | | 9/2006 | |
| JP | 2006256656 | A | | 9/2006 | |
| JP | 4138768 | B2 | | 8/2008 | |
| NZ | 272914 | A | | 7/1997 | |
| NZ | 280054 | A | | 9/1997 | |
| NZ | 299120 | A | | 12/1997 | |
| NZ | 330354 | A | | 9/1998 | |
| NZ | 330830 | | | 1/2000 | |
| NZ | 333185 | A | | 2/2000 | |
| NZ | 337406 | A | | 6/2001 | |
| NZ | 334196 | A | | 9/2001 | |
| NZ | 511904 | | | 12/2002 | |
| NZ | 506322 | | | 1/2003 | |
| NZ | 522201 | | | 2/2003 | |
| NZ | 505542 | | | 3/2003 | |
| NZ | 512955 | A | | 8/2003 | |
| NZ | 510085 | A | | 10/2003 | |
| NZ | 519573 | A | | 11/2003 | |
| NZ | 519160 | | | 12/2003 | |
| NZ | 519808 | | | 1/2004 | |
| NZ | 513752 | | | 2/2004 | |
| NZ | 531197 | A | | 5/2004 | |
| NZ | 515006 | A | | 6/2004 | |
| NZ | 532077 | A | | 6/2004 | |
| NZ | 521445 | A | | 8/2004 | |
| NZ | 518616 | A | | 11/2004 | |
| NZ | 523571 | A | | 11/2004 | |
| NZ | 539338 | A | | 12/2005 | |
| NZ | 525194 | A | | 1/2006 | |
| NZ | 530386 | A | | 6/2006 | |
| NZ | 531751 | A | | 7/2006 | |
| NZ | 542387 | A | | 9/2006 | |
| NZ | 532815 | A | | 1/2007 | |
| NZ | 541132 | A | | 5/2007 | |
| NZ | 545998 | A | | 8/2007 | |

(56) References Cited

FOREIGN PATENT DOCUMENTS

| | | | | |
|---|---|---|---|---|
| NZ | 543525 | A | 6/2008 | |
| NZ | 555516 | A | 7/2008 | |
| NZ | 547917 | A | 10/2008 | |
| NZ | 552423 | A | 12/2008 | |
| NZ | 571924 | A | 3/2009 | |
| NZ | 567591 | A | 6/2009 | |
| NZ | 554833 | A | 7/2009 | |
| NZ | 551190 | A | 9/2009 | |
| NZ | 566916 | A | 12/2009 | |
| NZ | 584464 | A | 7/2010 | |
| NZ | 581480 | A | 3/2011 | |
| NZ | 568751 | A | 5/2011 | |
| NZ | 577975 | A | 7/2011 | |
| NZ | 569896 | A | 8/2011 | |
| NZ | 571742 | A | 8/2011 | |
| NZ | 582203 | A | 9/2011 | |
| NZ | 582515 | A | 9/2011 | |
| NZ | 582680 | A | 9/2011 | |
| NZ | 575790 | A | 10/2011 | |
| NZ | 575791 | A | 12/2011 | |
| NZ | 581650 | A | 3/2012 | |
| NZ | 578867 | A | 4/2012 | |
| NZ | 577407 | A | 5/2012 | |
| NZ | 581226 | A | 5/2012 | |
| NZ | 579602 | A | 6/2012 | |
| NZ | 597670 | | 6/2013 | |
| NZ | 613350 | | 8/2013 | |
| NZ | 592208 | | 10/2013 | |
| NZ | 598786 | | 11/2013 | |
| NZ | 609447 | | 11/2013 | |
| NZ | 617276 | | 1/2014 | |
| NZ | 607063 | | 4/2014 | |
| NZ | 704570 | | 8/2015 | |
| NZ | 710886 | | 8/2015 | |
| NZ | 705874 | | 9/2015 | |
| NZ | 704860 | | 10/2015 | |
| NZ | 628779 | | 11/2015 | |
| NZ | 706489 | | 2/2016 | |
| NZ | 711550 | | 3/2016 | |
| NZ | 704856 | | 1/2019 | |
| WO | 8702336 | A1 | 4/1987 | |
| WO | 9302599 | A1 | 2/1993 | |
| WO | 9404441 | A1 | 3/1994 | |
| WO | D0476640001 | | 3/1999 | |
| WO | D0488940004 | | 6/1999 | |
| WO | D0503630006 | | 1/2000 | |
| WO | 0073157 | A1 | 12/2000 | |
| WO | D0544850002 | | 12/2000 | |
| WO | D0571810001 | | 9/2001 | |
| WO | D0583030001 | | 12/2001 | |
| WO | D0662250001 | | 12/2004 | |
| WO | 2005047123 | A1 | 5/2005 | |
| WO | 2007007141 | A1 | 1/2007 | |
| WO | D0709990005 | | 11/2008 | |
| WO | D0709990007 | | 11/2008 | |
| WO | D0709990022 | | 11/2008 | |
| WO | 2009091998 | A1 | 7/2009 | |
| WO | D0721030001 | | 7/2009 | |
| WO | D0721030002 | | 7/2009 | |
| WO | D0721030003 | | 7/2009 | |
| WO | D0721030004 | | 7/2009 | |
| WO | D0721030005 | | 7/2009 | |
| WO | D0721030006 | | 7/2009 | |
| WO | D0721030007 | | 7/2009 | |
| WO | D0721030008 | | 7/2009 | |
| WO | D0721030009 | | 7/2009 | |
| WO | D0721030010 | | 7/2009 | |
| WO | D0721030011 | | 7/2009 | |
| WO | D0721030012 | | 7/2009 | |
| WO | D0721030013 | | 7/2009 | |
| WO | D0721030014 | | 7/2009 | |
| WO | D0721030015 | | 7/2009 | |
| WO | D0721030016 | | 7/2009 | |
| WO | D0721030017 | | 7/2009 | |
| WO | D0721030018 | | 7/2009 | |
| WO | D0721030019 | | 7/2009 | |
| WO | D0721030020 | | 7/2009 | |
| WO | D0721030021 | | 7/2009 | |
| WO | D0721030022 | | 7/2009 | |
| WO | D0721030023 | | 7/2009 | |
| WO | 2009104207 | A1 | 8/2009 | |
| WO | WO 2009104207 | A1 * | 8/2009 | ..... B65D 75/32 |
| WO | 2010060120 | A3 | 5/2010 | |
| WO | 2010066427 | A1 | 6/2010 | |
| WO | 2010068593 | A2 | 6/2010 | |
| WO | 2010070500 | A3 | 6/2010 | |
| WO | D0741310007 | | 8/2010 | |
| WO | 2011001200 | A1 | 1/2011 | |
| WO | 2011006943 | A1 | 1/2011 | |
| WO | 2011097530 | A1 | 8/2011 | |
| WO | 2011116957 | A1 | 9/2011 | |
| WO | 2011120887 | A1 | 10/2011 | |
| WO | 2011120888 | A1 | 10/2011 | |
| WO | 2011120889 | A1 | 10/2011 | |
| WO | 2011133851 | A2 | 10/2011 | |
| WO | D0786150001 | | 11/2011 | |
| WO | D0786150002 | | 11/2011 | |
| WO | D0786150003 | | 11/2011 | |
| WO | D0786150004 | | 11/2011 | |
| WO | D0786150005 | | 11/2011 | |
| WO | D0786150006 | | 11/2011 | |
| WO | D0786150007 | | 11/2011 | |
| WO | D0786150008 | | 11/2011 | |
| WO | D0786150009 | | 11/2011 | |
| WO | D0786150012 | | 11/2011 | |
| WO | D0786150019 | | 11/2011 | |
| WO | D0786150020 | | 11/2011 | |
| WO | D0786150021 | | 11/2011 | |
| WO | 2012019222 | A1 | 2/2012 | |
| WO | 2012023072 | A2 | 2/2012 | |
| WO | 2012025194 | A1 | 3/2012 | |
| WO | 2012038228 | A1 | 3/2012 | |
| WO | D0788860003 | | 7/2012 | |
| WO | 2012119198 | A1 | 9/2012 | |
| WO | D0792260001 | | 9/2012 | |
| WO | 2012141986 | A1 | 10/2012 | |
| WO | 2012156956 | A1 | 11/2012 | |
| WO | 2013072869 | A1 | 5/2013 | |
| WO | 2013075989 | A1 | 5/2013 | |
| WO | D0809510005 | | 5/2013 | |
| WO | D0809510007 | | 5/2013 | |
| WO | D0809510008 | | 5/2013 | |
| WO | 2013081810 | A1 | 6/2013 | |
| WO | 2013093628 | A1 | 6/2013 | |
| WO | 2013098544 | A1 | 7/2013 | |
| WO | 2013123561 | A1 | 8/2013 | |
| WO | 2013131126 | A1 | 9/2013 | |
| WO | 2013134547 | A1 | 9/2013 | |
| WO | 2013138580 | A1 | 9/2013 | |
| WO | 2013141769 | A1 | 9/2013 | |
| WO | 2013144612 | A2 | 10/2013 | |
| WO | 2013153530 | A1 | 10/2013 | |
| WO | 2013173503 | A1 | 11/2013 | |
| WO | 2013177072 | A1 | 11/2013 | |
| WO | 2013181698 | A1 | 12/2013 | |
| WO | D0825560007 | | 12/2013 | |
| WO | D0825560008 | | 12/2013 | |
| WO | D0825560009 | | 12/2013 | |
| WO | 2014014349 | A1 | 1/2014 | |
| WO | 2014052421 | A1 | 4/2014 | |
| WO | D0842580001 | | 5/2014 | |
| WO | D0842580002 | | 5/2014 | |
| WO | D0842580003 | | 5/2014 | |
| WO | D0842580004 | | 5/2014 | |
| WO | D0842580005 | | 5/2014 | |
| WO | D0842580006 | | 5/2014 | |
| WO | D0842580007 | | 5/2014 | |
| WO | 2014121865 | A1 | 8/2014 | |
| WO | 2014122057 | A1 | 8/2014 | |
| WO | 2014125878 | A1 | 8/2014 | |
| WO | 2014127213 | A1 | 8/2014 | |
| WO | 2014134591 | A1 | 9/2014 | |
| WO | 2014135594 | A1 | 9/2014 | |
| WO | 2014135882 | A3 | 9/2014 | |

(56) References Cited

FOREIGN PATENT DOCUMENTS

| | | | |
|---|---|---|---|
| WO | 2014136725 | A1 | 9/2014 |
| WO | 2014140394 | A1 | 9/2014 |
| WO | 2014141131 | A1 | 9/2014 |
| WO | 2014141839 | A1 | 9/2014 |
| WO | 2014142860 | A1 | 9/2014 |
| WO | 2014142893 | A1 | 9/2014 |
| WO | 2014146957 | A1 | 9/2014 |
| WO | 2014147421 | A1 | 9/2014 |
| WO | 2014147751 | A1 | 9/2014 |
| WO | 2014150125 | A2 | 9/2014 |
| WO | 2014150442 | A1 | 9/2014 |
| WO | 2014150834 | A1 | 9/2014 |
| WO | 2014155167 | A1 | 10/2014 |
| WO | 2014155315 | A1 | 10/2014 |
| WO | 2014155483 | A1 | 10/2014 |
| WO | 2014161055 | A1 | 10/2014 |
| WO | 2014161684 | A1 | 10/2014 |
| WO | 2014162689 | A1 | 10/2014 |
| WO | 2014170476 | A1 | 10/2014 |
| WO | 2014170651 | A1 | 10/2014 |
| WO | 2014171181 | A1 | 10/2014 |
| WO | 2014176292 | A1 | 10/2014 |
| WO | 2014179849 | A1 | 11/2014 |
| WO | 2014181752 | A1 | 11/2014 |
| WO | 2014186259 | A1 | 11/2014 |
| WO | 2014186725 | A1 | 11/2014 |
| WO | 2014187514 | A1 | 11/2014 |
| WO | 2014187741 | A1 | 11/2014 |
| WO | 2014188358 | A1 | 11/2014 |
| WO | 2014188394 | A1 | 11/2014 |
| WO | 2014188395 | A1 | 11/2014 |
| WO | 2014195008 | A2 | 12/2014 |
| WO | 2014198800 | A2 | 12/2014 |
| WO | 2014199245 | A1 | 12/2014 |
| WO | 2014199856 | A1 | 12/2014 |
| WO | 2014202927 | A1 | 12/2014 |
| WO | 2014206939 | A1 | 12/2014 |
| WO | 2015001343 | A1 | 1/2015 |
| WO | 2015001406 | A1 | 1/2015 |
| WO | 2015001598 | A1 | 1/2015 |
| WO | 2015004524 | A1 | 1/2015 |
| WO | 2015011186 | A1 | 1/2015 |
| WO | 2015012176 | A1 | 1/2015 |
| WO | D0854320001 | | 1/2015 |
| WO | D0854320015 | | 1/2015 |
| WO | D0854320016 | | 1/2015 |
| WO | D0854320017 | | 1/2015 |
| WO | D0854320018 | | 1/2015 |
| WO | D0854320019 | | 1/2015 |
| WO | D0854320020 | | 1/2015 |
| WO | D0854320021 | | 1/2015 |
| WO | 2015015333 | A1 | 2/2015 |
| WO | 2015019228 | A2 | 2/2015 |
| WO | 2015023207 | A1 | 2/2015 |
| WO | 2015023702 | A1 | 2/2015 |
| WO | 2015024084 | A1 | 2/2015 |
| WO | 2015026832 | A2 | 2/2015 |
| WO | 2015027292 | A1 | 3/2015 |
| WO | 2015027795 | A1 | 3/2015 |
| WO | 2015027857 | A1 | 3/2015 |
| WO | 2015028917 | A1 | 3/2015 |
| WO | 2015030747 | A1 | 3/2015 |
| WO | 2015031962 | A1 | 3/2015 |
| WO | 2015031964 | A1 | 3/2015 |
| WO | 2015032142 | A1 | 3/2015 |
| WO | 2015033164 | A1 | 3/2015 |
| WO | 2015038513 | A1 | 3/2015 |
| WO | 2015039462 | A1 | 3/2015 |
| WO | 2015039642 | A1 | 3/2015 |
| WO | 2015041323 | A1 | 3/2015 |
| WO | 2015045025 | A1 | 4/2015 |
| WO | 2015045049 | A1 | 4/2015 |
| WO | 2015045070 | A1 | 4/2015 |
| WO | 2015046145 | A1 | 4/2015 |
| WO | 2015049061 | A1 | 4/2015 |
| WO | 2015049692 | A1 | 4/2015 |
| WO | 2015049702 | A1 | 4/2015 |
| WO | 2015054442 | A1 | 4/2015 |
| WO | 2015058248 | A1 | 4/2015 |
| WO | 2015058934 | A1 | 4/2015 |
| WO | 2015059601 | A1 | 4/2015 |
| WO | 2015060073 | A1 | 4/2015 |
| WO | 2015060529 | A1 | 4/2015 |
| WO | 2015066109 | A1 | 5/2015 |
| WO | 2015066144 | A1 | 5/2015 |
| WO | 2015068236 | A1 | 5/2015 |
| WO | 2015069009 | A1 | 5/2015 |
| WO | 2015079363 | A1 | 6/2015 |
| WO | 2015079513 | A1 | 6/2015 |
| WO | 2015079927 | A1 | 6/2015 |
| WO | 2015082876 | A1 | 6/2015 |
| WO | 2015084904 | A1 | 6/2015 |
| WO | 2015086298 | A1 | 6/2015 |
| WO | 2015086884 | A1 | 6/2015 |
| WO | 2015087158 | A2 | 6/2015 |
| WO | 2015096558 | A1 | 7/2015 |
| WO | 2015096559 | A1 | 7/2015 |
| WO | 2015097288 | A1 | 7/2015 |
| WO | 2015097604 | A1 | 7/2015 |
| WO | 2015097827 | A1 | 7/2015 |
| WO | 2015099813 | A1 | 7/2015 |
| WO | 2015101456 | A1 | 7/2015 |
| WO | 2015104612 | A1 | 7/2015 |
| WO | 2015106712 | A1 | 7/2015 |
| WO | 2015110914 | A1 | 7/2015 |
| WO | 2015115096 | A1 | 8/2015 |
| WO | 2015115533 | A1 | 8/2015 |
| WO | 2015116752 | A1 | 8/2015 |
| WO | 2015119021 | A1 | 8/2015 |
| WO | 2015121643 | A2 | 8/2015 |
| WO | 2015122066 | A1 | 8/2015 |
| WO | 2015124643 | A1 | 8/2015 |
| WO | 2015124830 | A1 | 8/2015 |
| WO | 2015125292 | A1 | 8/2015 |
| WO | 2015131295 | A1 | 9/2015 |
| WO | 2015137798 | A1 | 9/2015 |
| WO | 2015138656 | A1 | 9/2015 |
| WO | 2015139648 | A1 | 9/2015 |
| WO | 2014154281 | A1 | 10/2015 |
| WO | 2015147180 | A1 | 10/2015 |
| WO | 2015151100 | A1 | 10/2015 |
| WO | 2015154198 | A1 | 10/2015 |
| WO | 2015154281 | A1 | 10/2015 |
| WO | 2015160248 | A1 | 10/2015 |
| WO | 2015165009 | A1 | 11/2015 |
| WO | 2015165406 | A1 | 11/2015 |
| WO | 2015166341 | A1 | 11/2015 |
| WO | 2015168045 | A1 | 11/2015 |
| WO | 2015177683 | A1 | 11/2015 |
| WO | D0888940001 | | 11/2015 |
| WO | 2014203220 | A1 | 12/2015 |
| WO | 2016079663 | A1 | 5/2016 |
| WO | 2016120033 | A1 | 8/2016 |
| WO | D0941140001 | | 12/2016 |

OTHER PUBLICATIONS

Patent Cooperation Treaty; International Search Report; PCT/GB2014/050667; International Filing Date: Mar. 6, 2014; 7 pages.

First Examination Report; New Zealand Application No. 709425; dated Nov. 9, 2015; 5 Pages.

International Preliminary Report on Patentability; International Application No. PCT/GB2014/050665; International Filing Date: Mar. 6, 2014; dated Sep. 8, 2015; 9 Pages.

International Preliminary Report on Patentability; International Application No. PCT/GB2014/050667; International Filing Date: Mar. 6, 2014; dated Sep. 8, 2015; 9 Pages.

Search Report; Great Britain Appln. No. 1304167.8; dated Aug. 9, 2013; 2 Pages.

Search Report; Great Britain Appln. No. 1304167.8; dated May 12, 2014; 2 Pages.

Second Search Report; Great Britain Appln. No. 1304167.8; dated May 12, 2014; 2 Pages.

(56) References Cited

OTHER PUBLICATIONS

Written Opinion of the International Searching Authority; International Application No. PCT/GB2014/050665; International Filing Date: Mar. 6, 2014; dated Sep. 29, 2014; 8 Pages.
Written Opinion of the International Searching Authority; International Application No. PCT/GB2014/050667; International Filing Date: Mar. 6, 2014; dated Sep. 29, 2014; 8 Pages.
Search Report under Section 17; Great Britain Application No. 1304169.4; dated Aug. 8, 2013; 2 Pages.
Advisory Action; U.S. Appl. No. 14/388,127, filed Sep. 25, 2014; Packaging and Method of Opening; dated Sep. 16, 2016; 3 Pages.
Communication pursuant to Rule 164(2)(b) and Article 94(3) EPC; European Application No. 14710356.8; dated Nov. 30, 2016; 3 Pages.
Communication under Rule 164(2)(a) EPC; European Application No. 14710356.8; dated Oct. 28, 2016; 4 Pages.
Final Office Action; U.S. Appl. No. 14/388,127, filed Sep. 25, 2014; Packaging and Method of Opening; dated Jun. 10, 2016; 11 Pages.
Final Office Action; U.S. Appl. No. 14/388,127, filed Sep. 25, 2014; Packaging and Method of Opening; dated Nov. 17, 2017; 8 Pages.
First Office Action & Search Report; Chinese Appln. No. 201380017248.2; dated Jun. 18, 2015; 22 Pages.
Further Examination Report; New Zealand Application No. 629719; dated Jan. 8, 2016; 2 Pages.
Further Search Report under Section 17; Great Britain Application No. 1304169.4; dated May 12, 2014; 2 Pages.
International Search Report and Written Opinion of the International Searching Authority; International Application No. PCT/GB2013/050790; International Filing Date: Mar. 26, 2013; dated Oct. 14, 2013; 15 Pages.
Non-Final Office Action; U.S. Appl. No. 14/388,127, filed Sep. 25, 2014; Packaging and Method of Opening; dated Oct. 7, 2015; 12 Pages.
Non-Final Office Action; U.S. Appl. No. 14/388,127, filed Sep. 25, 2014; Packaging and Method of Opening; dated Feb. 7, 2017; 11 Pages.
Non-Final Office Action; U.S. Appl. No. 14/765,137, filed Jul. 31, 2015; Improved Packaging and Method of Opening; dated Feb. 2, 2017; 24 Pages.
Notice of Allowance; U.S. Appl. No. 14/765,137, filed Jul. 31, 2015; Improved Confectionery Packaging and Method of Opening; dated Sep. 27, 2017; 8 Pages.
Office Action and Examination Search Report; Canadian Application No. 2,900,899; dated Feb. 13, 2017; 3 Pages.
Restriction Requirement; U.S. Appl. No. 14/765,137, filed Jul. 31, 2015; Improved Packaging and Method of Opening; dated Sep. 2, 2016; 9 Pages.
Search Report under Section 17; Great Britain Application No. 1205243.7; dated Jul. 26, 2012; 1 Page.
Communication Pursuant to Articie 94(3) EPC; European Application No. 14710354.3; dated Nov. 14, 2017; 7 Pages.
Communication Pursuant to Article 94(3) EPC; European Application No. 14710356.8; dated Sep. 27, 2017; 6 Pages.
Communication pursuant to Article 94(3) EPC; European Application No. 16166235.8; dated Sep. 25, 2017; 4 Pages.
Communication Pursuant to Article 94(3) EPC; European Application No. 17151673.5; dated Sep. 20, 2017; 7 Pages.
Examination Report; Great Britain Application No. 1304167.8; dated May 3, 2018; 1 Page.
Machine Translation from the EPO; Chinese Patent No. 2185250; Publication Date: Dec. 14, 1994; 4 Pages.
Notification of the First Office Action; Chinese Application No. 201480011314.X; dated May 17, 2016; 1 Page.
Notification of the First Office Action; Chinese Application No. 201610868211.6; dated May 23, 2018; 10 Pages.
Notification of the First Office Action; Chinese Application No. 201611099710.X; dated Jun. 19, 2018; 5 Pages.
Patens Act 1977 Examination Report under Section 18(3); Great Britain Application No. 1304167.8; dated Nov. 24, 2017; 1 Page.
Patents Act 1977: Examination Report under Section 18(3); Great Britain Application No. 1304167.8; dated Jul. 27, 2018; 9 Pages.
Patents Act 1977: Examination Report under Section 18(3); Great Britain Application No. 1304169.4; dated Nov. 30, 2017; 6 Pages.
Patents Act 1977: Examination Report under Section 18(3); Great Britain Application No. 1304169.4; dated May 3, 2018; 7 Pages.
ROG (2011) "I-Mockery's Ultimate Guide to the Halloween Candies of 2011"; URL Accessed: http://www.i-mockery.com/minimocks/halloween-candy2011/default; Date Accessed: Mar. 27, 2018; 9 Pages.
Case Details Report; New Zealand Patent No. 624638; Filing date: May 7, 2014; 2 Pages.
Case Details Report; New Zealand Patent No. 628399; Filing date: Aug. 7, 2014; 2 Pages.
Case Details Report; New Zealand Patent No. 712699; Filing date: Aug. 7, 2014; 2 Pages.
Hague Registration Details; International Registration No. DM/027376; Publication Date: Nov. 30, 1993; 2 Pages.
Hague Registration Details; International Registration No. DM/028567; Publication Date: Mar. 31, 1994; 2 Pages.
Hague Registration Details; International Registration No. DM/035732; Publication Date: May 31, 1996; 3 Pages.
Hague Registration Details; International Registration No. DM/040299; Publication Date: Jul. 31, 1997; 11 Pages.
Hague Registration Details; International Registration No. DM/041549; Publication Date: Nov. 28, 1997; 4 Pages.
RCD File Information; European Union Design No. 000214796-0006; Registration Date: Aug. 13, 2004; 3 Pages.
RCD File Information; European Union Design No. 002502856-0001; Registration Date: Jul. 15, 2014; 4 Pages.

* cited by examiner

PACKAGING AND METHOD OF OPENING

FIELD

Disclosed is a food packaging for confectionery or the like and in particular, although not exclusively, to packaging that conforms to the shape of the packaged product such as packaging for confectionery eggs.

BACKGROUND

Confectionery eggs are often wrapped in a foil wrapper that conforms to the shape of the packaged confectionery egg. Here a rectangular foil sheet with graphics and the like printed on the outer side is wrapped around a confectionery egg to provide a protective barrier and maintain the confectionery egg in a hygienic condition ready for consumption. The foil is easily malleable so forms a close contour around the confectionery egg so that the packaged confectionery egg substantially maintains its outer profile. Because the foil is wrapped around the confectionery egg, it is not possible to provide a continuous graphic on the packaged product. Furthermore, the appearance of the packaged product is not always repeated. That is, the graphics on the outer surface of the foil can form differently from one production line to the next and even between packaged confectionery eggs on the same production line.

In use, the foil wrapped confectionery eggs can be sold individually from containers in which loose filled confectionery eggs are stored. Typically, the confectionery eggs will be stacked randomly on top of each other given the non-stacking shape. Once purchased, a consumer unwraps the packaged confectionery egg from the foil wrapper to consume the confectionery egg. The foil wrapper is able to be unwrapped because the packaging process does not seal the edges of the foil. The consumer therefore simply peels back an edge of the foil wrapper to begin opening. This opening procedure does not provide for a tamper evident packaging. That is, because the foil wrapper can be reclosed to substantially its original position, it is not possible for a consumer to know if the packaging has been tampered with, following dispatch from the confectionery plant.

SUMMARY

The disclosure attempts to overcome at least one of the above or other disadvantages. It is a further aim to provide a packaging and packaging method that may allow a packaging to conform to the shape of the packaged product whilst still providing a tamper evident closure and additionally or alternatively an improved graphical consistency on the outer surface of the packaged product. It is a further aim to provide an improved method of opening a packaging that conforms to the shape of the packaged product, with a particular aim being to allow a user to consume the product with reduced direct handling of the product. Other aims include providing a packaging for a non-stable shaped product having improved ease of display and handling as well as providing an element of fun and playfulness to the packaging and opening method.

There is herein provided a confectionery packaging, a method of packaging a confectionery product, and a method of opening said confectionery packaging as set forth in the appended claims. Other features will be apparent from the dependent claims, and the description which follows.

According to the exemplary embodiments, a confectionery packaging is provided that is ideally suited to packaging shaped products and in particular, shaped products such as eggs or ovoid or cylinders or complex shapes including the same whose shape does not offer a natural stability. That is, shapes that are prone to rolling or tipping or the like. The exemplary embodiments could even be applied to more stable geometric shapes like bars where it is desirable to stand the product on a thin or narrow edge. Consequently, although herein, the exemplary embodiments will be described with reference to packaging an egg-shaped product, other shapes are envisaged and the reader will understand that the packaging can be readily adopted to suit other shapes by changing the shape of the packaging. In each embodiment, main surfaces of the packaging are shaped so that the formed internal space conforms to the shape and size of the packaged product. Here, the internal volume may be less than 115% or less than 110% or less than 105% of the volume of the product to be packaged. Suitably, any internal dimensions are less than 105% of the corresponding dimension of the packaged product.

Suitably the main surfaces of at least one of the first and second parts of the confectionery packaging comprise a non-planar portion. Suitably the main surfaces of both of the first and second parts of the confectionery packaging comprise a non-planar portion.

Suitably the main surfaces of at least one of the first and second parts of the confectionery packaging comprise a curved portion. Suitably the main surfaces of both of the first and second parts of the confectionery packaging comprise a curved portion.

Suitably the non-planar and/or curved portion or portions cause the confectionery packaging to be unstable when placed on a substantially flat, level surface and therefore cause the confectionery packaging to be prone to rolling or tipping when placed on said surface. Some exemplary embodiments address the inherent instability or such confectionery packing.

Suitably at least one of the first and second parts of the confectionery packaging comprises a portion on which the confectionery packaging is unstable (i.e. prone to rolling or tipping) when the confectionery packaging is placed on a planar, level surface. Suitably both of the first and second parts of the confectionery packaging comprise a portion on which the confectionery packaging is unstable (i.e. prone to rolling or tipping) when the confectionery packaging is placed on a planar, level surface. The non-planar and/or curved portion or portions might be described or defined as a typical resting surface of the packaging. That is, a resting surface is one which sits on a supporting surface that does not form part of the packaging (e.g. a table, counter, shelf or the like).

Suitably the main surfaces of at least one of the first and second parts of the confectionery packaging are entirely non-planar. Suitably the main surfaces of both of the first and second parts of the confectionery packaging are entirely non-planar. Confectionery packaging wherein one or both of the first and second parts (or, e.g., at least a typical resting surface) are entirely non-planar are unstable (i.e. prone to rolling or tipping) when placed on a planar, level surface so that the entirely non-planar first or second part contacts the planar, level surface. Examples of such confectionery packaging include egg-shaped, ovoid, ellipsoid and spherical confectionery packaging and also include more complex shapes. Such confectionery packaging shapes are attractive to consumers but are inherently unstable when placed on a planar, level surface. Some exemplary embodiments address the inherent instability of these confectionery packaging shapes by providing one or more stabilising features.

The main surfaces and/or any reference to the surface may exclude (i.e. not include) the flange(s).

Suitably the confectionery packaging has a shape selected from egg-shaped, ovoid, spherical, ellipsoid and cylindrical. Suitably the confectionery packaging is egg-shaped, ovoid, ellipsoid or spherical. Suitably the confectionery packaging is egg-shaped or ovoid, to mimic, match or mirror an egg or ovoid product in or for the packaging.

Suitably the confectionery packaging has a shape which has no (e.g. major or main) planar surfaces (with the exception of any flanges, or other stabilising feature described herein). Suitably the confectionery packaging has a (e.g. main) shape which is entirely non-planar (with the exception of any flanges, or other stabilising feature described herein).

Suitably the confectionery packaging comprises at least one entirely curved circumference, for example being at least partly egg-shaped, ovoid, spherical, ellipsoid and/or cylindrical. Suitably the confectionery packaging comprises at least two entirely curved circumferences which are orthogonal to each other (or at least extend in different directions), for example an egg-shape, spherical, ovoid or ellipsoid. Such a shape is likely to be more unstable than a shape that comprises only one entirely curved circumference, for example a cylinder, which has flat/planar end surfaces on which the shape can stably rest.

The shape of the confectionery packaging referred to above may exclude the flange(s).

Suitably the confectionery packaging has an elongate shape, for example egg-shaped, ovoid, ellipsoid or cylindrical.

In each exemplary embodiment, the confectionery packing provides a sealed enclosure for a packaged product by sealing together two parts. Each part covers at least 30% of the surface of the product to be packaged. Moreover, the parts are sealed together at a flange seal, wherein flanges on either part are sealed together in a face-to-face relationship. Here, the flanges extend around an open mouth of each shell part. Suitably, the flanges extend away from main surfaces of each part. Suitably, the packaging substantially conforms to the shape of the confectionery except for the flanges. Typically, the flanges are orthogonal to the direction of closure of the two parts. However, other arrangements are envisaged and some exemplary embodiments include the flanges extending away from the main surfaces at other angles as well as the flanges extending in arcuate or otherwise non-planar fashion. The two parts can be joined in any known manner including, but not exclusively limited to; induction sealing, heat sealing, ultrasonic sealing, and cold sealing.

In each exemplary embodiment, at least one of the parts of the confectionery packaging is formed from a substantially rigid material. That is, the part is preformed into a desired shape, and the part maintains that shape. Advantageously, the preformed part acts as a holder for the packaged product when opened and during the packaging process. Substantially rigid includes the preformed part being easily deformable when put under pressure between a user's digits. Pre-formed parts typically have a constant thickness and can be formed from any known process such as casting, moulding, injection moulding, pressing, or any other suitable technique, though thermoforming is particularly suitable. It will be appreciated that the constant thickness may include variations in manufacturing tolerances as well as deliberately designed areas of increased or decreased thickness for particular features.

In some embodiments, the confectionery packaging is flexible. Suitably the confectionery packaging is formed from a flexible material. Suitably the flexible confectionery packaging can be deformed or bent by the handling of a user during an opening operation. Suitably the flexible confectionery packaging can be opened by peeling one of the first and second parts away from the other of the first and second parts so that at least one of the first and second parts is significantly deformed or bent with respect to its original shape. Suitably the flexible confectionery packaging has sufficient rigidity to maintain its shape when closed but can deform and bend during an opening operation. The deformed or bent parts may stay substantially deformed or bent after deformation or bending.

The other of the two parts may be similarly formed to the first. That is to say, the other of the two parts may be preformed. Alternatively, the other of the two parts may be formed from a foil or other flexible material. Parts formed from flexible films include aluminium films and the like. In this case, the flange of the aluminium film is the perimeter of the film that overlays the flange of the pre-formed part. Here, suitably a shrink film technology is adopted to cause the film to shape against the packaged product.

By forming the exemplary embodiments from pre-formed parts and films, graphics and the like can be printed or applied to the outside of the parts. This enables repeatable and clear graphics to be used. For instance, words and logos can be correctly formed even when the outside of the packaging is contoured. In contrast, when wrapping a packaged confectionery in foil, often words and logos are not easily distinguishable. In addition, because the packaging is completely sealed and cannot be opened without breaking, a tamper evident wrapping is provided.

According to one exemplary embodiment, a confectionery packing is provided with an exaggerated flange that extends continuously about a periphery of the packaging. The packaging is opened to reveal an enclosed product by separating the packaging along the exaggerated flange to separate the packaging into two pieces. Here, the term exaggerated flange means a flange that extends away from main surfaces of the packaging a distance typically greater than 20% or 30% of a centre line across an opening formed in one of the separated parts. Advantageously, the exaggerated flange provides a stop to prevent the packaging from rolling. Furthermore, a secondary packaging is suitably provided wherein multiple packages can be stowed. For instance, here the secondary packaging includes apertures for receiving part of each package. For Point of Sale purposes, or for transport, or for multiple sale purposes, a package having the exaggerated flange may be placed in each aperture. The exaggerated flange abuts a surface of the secondary packaging having the aperture. Typically, each package would be suspended by the abutment between the secondary packaging and exaggerated flange. Moreover, the exaggerated flange may be shaped to provide a fun aesthetic.

In one exemplary embodiment, a confectionery packaging is provided wherein multiple packages are joined by their flanges. That is, at least one of the parts includes a plurality of hollows each for receiving a product to be packaged. Here, the confectionery packaging can be separated into individual packages by separating through weakened lines or perforations.

The exemplary embodiments may suitably include an aperture for hanging the packaging when displaying at point of sale. Here, the aperture is suitably formed through the flanges.

In some particularly exemplary embodiments, the flanges in each part are not arranged to register directly with each other. Rather, at least in part, one of the flanges is arranged to be larger than the other. This causes an area of the sealed flanges to form a grasping part, which only includes part of a flange from one piece of the packaging. Consequently there is provided an easy opening function whereby the user may use the part of the sealed flanges with only one piece to grip the packaging and initiate the separation of the pieces along the flange seal. It will be appreciated that typically this will comprise a peeling action. Accordingly there is provided an exemplary confectionery packaging comprised of two parts each having a flange extending continuously about a perimeter of an opening to each part, wherein the packaging is formed by sealing the two flanges together and wherein the flanges are arranged not to register perfectly with each other. Yet further, there is provided an exemplary method of opening a confectionery packaging wherein the user grips a part of a sealed flange that extends about a continuous periphery of the packaging and includes a flange of one part of the packaging being sealed to a flange of another part of the packaging, said part of the flange that the user grasps comprising only a portion of one of the flanges and not the other, the method comprising using said grasping portion to peel one part away from the other so that the packaging separates along the sealed flange.

In one exemplary embodiment, flanges on both parts are arranged to include an oversized region. That is, a plurality of grasping portions are provided, wherein at least one grasping portion includes only a part of the flange of one part and at least one of the other grasping portions includes only a part of the flange of the other part. Moreover, the oversized regions in each part are ideally arranged adjacent one another so that they allow the user to pull the two parts away from each other. This further enhances the opening characteristics of the packaging.

In other exemplary embodiments, the flange of one of the parts is formed with a weakened line or fracture zone through which the flange is arranged to break when a shear force is applied. The weakened line extends across the flange so that when the shear force is applied, a part of the flange breaks away from the main part of the flange. Here, the flanges are sealed together in registration. When a shear force is applied to the weakened line, the flange in one of the parts fractures. The user is then grasping only one of the flanges and the two parts can be separated by peeling apart as herein described. Consequently there is provided an exemplary confectionery packaging comprised of two parts each having a flange extending continuously about a perimeter of an opening to each part, wherein the packaging is formed by sealing the two flanges together and wherein one of the flanges includes a weakened line through which the flange is arranged to fracture. Here, the packaging is opened as with the previous exemplary embodiment except that the grasping portion becomes the part of the sealed flange including the part of the flange that is arranged to separate from the main flange when fractured. As with the previous exemplary embodiment, the other of the parts may include a fracture zone in another position so that two grasping portions are provided. The grasping portions are ideally arranged adjacent each other.

In the exemplary embodiments the sealed flanges can form a continuous perimeter around the packaging taking any number of routes. Here continuous perimeter includes arrangements wherein the flange is substantially continuous but at one or more portions reduces or is not formed. In some of the exemplary embodiments, the flanges are substantially planar. There is therefore provided an exemplary confectionery packaging comprised of two parts each having a flange extending continuously about a perimeter of an opening to each part, wherein the packaging is formed by sealing the two flanges together and wherein the flanges extend in a planar direction. However, in alternative embodiments, the flanges are non-planar and have a curved or wavy profile in on or two axes. Consequently, there is also provided an exemplary confectionery packaging comprised of two parts each having a flange extending continuously about a perimeter of an opening to each part, wherein the packaging is formed by sealing the two flanges together and wherein the flanges extend in a non-planar direction.

Furthermore, in some exemplary embodiments, the flanges are formed substantially about the x-axis or waist axis. In this case there is provided an exemplary confectionery packaging comprised of two parts each having a flange extending continuously about a perimeter of an opening to each part, wherein the packaging is formed by sealing the two flanges together and wherein the flanges extend substantially in a plane parallel to the waist of the product. Alternatively, the flanges are formed substantially in the y-axis or tip-to-tip axis of the packaging. Here, there is provided an exemplary confectionery packaging comprised of two parts each having a flange extending continuously about a perimeter of an opening to each part, wherein the packaging is formed by sealing the two flanges together and wherein the flanges extend in a plane parallel to the tip-to-tip direction of the product. In particularly exemplary embodiments however, the sealed flanges are formed substantially along a plane angled to the x-axis or y-axis. According to this exemplary embodiment, there is provided an exemplary confectionery packaging comprised of two parts each having a flange extending continuously about a perimeter of an opening to each part, wherein the packaging is formed by sealing the two flanges together and wherein the flanges extend in a plane angled to waist or the tip-to-tip direction of the product Suitably the flanges of the exemplary embodiments are all formed about a mouth that provides the widest point of each part. That is to say that each part does not trap the packaged product so that the packaged product can be removed from both parts. In some embodiments however, it is desirable for one part of the packaging to provide a holder whilst the product is consumed. Here it is preferable for the packaged product to be easily accessible when one part is removed.

The exemplary embodiments provide varying selling points. For instance, the waist flange allows the packaging to sit upright in a secondary packaging as herein described. Alternatively when the flanges are formed in the tip-to-tip axis, each part, or at least the major part of the packaging is conveniently held between the thumb and forefinger. In the particular exemplary embodiments wherein the flanges are formed substantially along a plane angled to one of the major axis of the shape, the part having a larger part of the waist of the shape provides a convenient holder for the packaged product. To aid the handle-ability of the packaging, the flanges can be arranged to curl as they extend away from the main surfaces. For instance, the flanges could curl up or down depending on the part being held.

In some exemplary embodiments, the confectionery packaging is adapted to provide a stable orientation when placed on a level surface. Here, at least a part of one or both flanges is arranged to extend a sufficient distance from the main surfaces such that the flanges come in to contact with the level surface when the packaged product is placed thereon. As well as the contact with the flange, when stood on the level surface, at least one portion of the main surfaces of the packaging is arranged to also contact the level surface. Importantly, the shape of the packaging is such that the centre of gravity of the packaging acts through or between the points of contact. Preferably, the centre of gravity acts downwards between and spaced from each contact. Furthermore, at least one of the contacts, that is either the contact between the level surface and flange or the contact between the level surface and main surface of the packaging contacts the surface either side of the centre of gravity when viewed from a view orthogonal to the first. Again, although the centre of gravity can act through one of the points of contact in the orthogonal direction, it is preferable if the centre of gravity acts downwards between and spaced from each contact.

Suitably in an exemplary embodiment, the part of the main surface of the packaging arranged to contact the level surface is adapted to include a stand feature such as a rib to provide increased stability. The rib could be hollow or solid. Furthermore, the flanges may be curled or bent at the distal ends to form a larger surface are or foot to act as the contact point with the level surface.

It will be appreciated that the exemplary embodiments can be arranged and shaped so that the product stands in any orientation. For instance, it is thought that for point of sale purposes a suitable orientation may be for the product to be stood up right so that the tip-to-tip direction is aligned upwardly. However, other orientations are envisaged including the tip-to-tip axis being arranged at a slanted angle.

In the exemplary embodiments described herein the exemplary embodiments of the confectionery packaging have been formed of two parts joined at a flange seal. In one exemplary embodiment, the two parts are not entirely separate. Rather, the two parts remain joined at a hinge. The hinge is typically formed by a weakened line across the part. Here, the packaging is formed by folding the packaging about the hinge to bring the flanges of each part in to contact for sealing. This enables the two parts to stay connected to each other when the user separates the parts along the seal to consume the product. Furthermore, in the exemplary embodiments the flanges may be sealed with Pressure Sensitive Adhesive (PSA) to allow recloseability of the packaging. Here, the two parts being joined by a hinge improves the recloseability function.

In exemplary embodiments wherein the main surfaces of at least one of the first and second parts of the confectionery packaging comprise a non-planar portion, the confectionery packaging may comprise an arrangement of one or more main surfaces and centre of gravity which allows the confectionery packaging, optionally containing confectionery, to adopt a stable orientation (i.e. a resting position) on the non-planar portion when the non-planar portion contacts a planar, level surface.

Suitably the confectionery packaging has an arrangement of one or more main surfaces and centre of gravity which allows the confectionery packaging to return to such a stable orientation after being tilted from the stable orientation.

Suitably the confectionery packaging comprises an arrangement of main surfaces and centre of gravity which allows the confectionery packaging to only rest on a planar, level surface in one stable orientation.

Suitably the confectionery packaging which can adopt a stable orientation on a non-planar portion when the non-planar portion contacts a planar, level surface, comprises a localised increase in mass at or adjacent to a non-planar surface. Alternatively the localised increase in mass may be between the non-planar surface and a centre of volume of the confectionery packaging.

Suitably the localised increase in mass is provided by a portion of one of the first and second parts of the confectionery packaging. Suitably the portion of one of the first and second parts of the confectionery packaging which provides the localised increase in mass is formed from a thicker and/or denser material than the other portions of the first and second parts. For example the confectionery packaging may be formed from a polymer material and the localised increase in mass provided by a portion of the polymer material which is thicker compared to the majority of the packaging. Alternatively the confectionery packaging may be formed from a polymer material and the localised increase in mass provided by a polymer material which is more dense than the polymer material which forms the majority of the packaging.

Suitably the portion of one of the first and second parts of the confectionery packaging which provides the localised increase in mass is formed from a denser material than the other portions of the first and second parts. Suitably the portion of one of the first and second parts of the confectionery packaging which provides the localised increase in mass is formed from a metal. Alternatively the localised increase in mass may be provided by a different material, such as one or more of a polymer material, resin, stone or mineral.

In one exemplary embodiment the confectionery packaging includes a weight. The weight provides one portion of the packaging with a localised increase in mass as compared to the other parts of the packaging. The placement of the weight can be used to provide the packaging with a 'wobble' feature wherein, the packaging can be tipped so that the centre of gravity acts to one side of the contact point between the packaging and surface it is placed on. If the centre of gravity acts to the opposite side to that which the packaging has been tipped, the packaging is caused to move or rock back on itself. Inertia causes the part to overshoot the centre of gravity and a rocking motion generated. Consequently there is provided an exemplary embodiment wherein a packaging having a non-stable shape includes a weight giving a portion of the packaging a localised increased mass. The embodiment is ideally suited to substantially egg-shaped packaging as herein described. Moreover, although the packaging may be formed in a number of ways, the two part method described herein is again ideally suited. Here the weight is suitably arranged in the preformed part.

Suitably the confectionery packaging comprises a weight; wherein the weight provides one portion of the packaging with a localised increase in mass as compared to the other parts of the packaging; and wherein the placement of the weight provides the packaging with a wobble feature.

Suitably the packaging can be tipped so that the centre of gravity acts to one side of a contact point between the packaging and a surface it is placed on; and wherein the centre of gravity acts to the opposite side to that which the packaging has been tipped, causing the packaging to move or rock back on its self.

Suitably the packaging has a non-stable shape.

Suitably the packaging is egg or ovoid in shape.

Suitably the packaging comprises a first preformed part and a second part, wherein the first and second parts are sealed together about the confectionery at flanges that extend away from main surfaces of each part, said main surfaces substantially conforming to the shape of the confectionery.

According to the exemplary embodiments, there is provided a confectionery packaging for a confectionery, the packaging comprising a first preformed part and a second part, wherein the first and second parts are sealed together about the confectionery at flanges that extend away from main surfaces of each part, said main surfaces substantially conforming to the shape of the confectionery;

the flanges being arranged to provide a gripping portion that allows a consumer to grip the packaging in order to apply a separating force to separate one part from the other through the seal between the flanges.

Suitably a first gripping portion is provided to allow a user to apply a separating force to one part and a second gripping portion is provided to allow a user to apply a separating force to the other part.

Suitably the first and second gripping portions are arranged adjacent each other.

Suitably the or each gripping portion is provided by at least a portion of one flange overlying at least a portion of the other flange, and the portion of the flange that overlies the other flange forms the gripping portion.

Suitably the or each gripping portion is provided by at least a portion of one flange overlying and extending beyond at least a portion of the other flange, and the portion of the flange that overlies and extends beyond the other flange forms the gripping portion.

Suitably a plurality of portions of said one flange overlay a corresponding plurality of portions of said other flange to provide multiple gripping portions.

Suitably a plurality of portions of said one flange overlies and extends beyond a corresponding plurality of portions of said other flange to provide multiple gripping portions.

Suitably one of the flanges includes a first fracture zone that is arranged to fracture said flange into a main part and a distal end part when a force is applied to the fracture zone, the or each gripping portion being formed by a portion of one flange and the distal end part of said other flange.

Suitably a plurality of fracture zones are provided in said flange in order to form multiple gripping portions.

Suitably the flanges are joined at a plane and the plane is substantially planar.

Suitably the flanges are joined at a plane and the plane is arcuate in at least one axis.

Suitably the flanges are joined at a plane and the plane is wavy in at least one axis.

Suitably the planes are arcuate or wavy in both axes.

Suitably the confectionery packaging has an elongate shape, for example egg-shaped, ovoid, ellipsoid or cylindrical.

Suitably the flanges are joined at a plane and the plane extends parallel to a major axis of the confectionery.

The major axis corresponds to the longest dimension of the confectionery packaging, wherein the confectionery packaging has an elongate shape.

Suitably the confectionery packaging comprises at least one entirely curved circumference, the flanges are joined at a plane and the plane extends around the longest entirely curved circumference of the confectionery packaging.

Suitably the confectionery packaging comprises at least two entirely curved circumferences which are orthogonal to each other (or at least extending in different directions), the flanges are joined at a plane and the plane extends around the longest entirely curved circumference of the confectionery packaging (i.e. in a plane including and parallel to the major axis).

Suitably the confectionery packaging is egg-shaped, ovoid or ellipsoid, the flanges are joined at a plane and the plane extends around the longest entirely curved circumference of the packaging.

Suitably the flanges are joined at a plane and the plane extends parallel to a minor axis of the confectionery.

The minor axis is orthogonal to the major axis; wherein the confectionery packaging has an elongate shape.

Suitably the confectionery packaging comprises at least two entirely curved circumferences which are orthogonal to each other (or at least extending in different directions), the flanges are joined at a plane and the plane extends in a plane orthogonal to the longest entirely curved circumference of the confectionery packaging (i.e. in a plane including and parallel to the minor axis).

Suitably the confectionery packaging is egg-shaped, ovoid or ellipsoid, the flanges are joined at a plane and the plane extends around the waist of the packaging. The waist of the packaging is the longest entirely curved circumference around the packaging which is orthogonal to the overall longest entirely curved circumference of the packaging (i.e. in a plane including and parallel to the minor axis).

Suitably the flanges are joined at a plane and the plane extends at an angle to a major or minor axis of the confectionery.

Suitably the flanges are joined at a plane and the plane extends at an angle between a major and a minor axis of the packaging.

Suitably the confectionery packaging comprises at least two entirely curved circumferences which are orthogonal to each other (or at least extending in different directions), the flanges are joined at a plane and the plane extends at an angle between the at least two entirely curved circumferences of the confectionery packaging.

Suitably the confectionery packaging is egg-shaped, ovoid or ellipsoid, the flanges are joined at a plane and the plane extends at an angle between the longest entirely curved circumference and the waist of the packaging.

Suitably at least one of the flanges is arranged to extend so that a portion of at least one of the flanges is arranged to contact a linear plane that extends in first and second orthogonal directions when a portion of the main surface of one of the parts also contacts the linear plane.

A linear plane refers to a substantially flat surface on which the confectionery packaging may be placed in use. The linear plane is not part of the confectionery packaging.

Suitably the packaging is arranged such that the centre of gravity of the packaging acts between the contact between the plane and flange and the contact between the plane and main surface in one direction, and the flange or main surface being adapted to provide two spaced contacts either side of the centre of gravity in the second direction.

Suitably the portion of the flange that extends to contact the linear plane includes a gripping portion.

Suitably the flange is adapted to provide the two spaced contacts in the second direction, and one of the spaced contacts forms a gripping portion to apply a separating force to one of the parts and the other of the spaced contacts forms a gripping portion to apply a separating force to the other of the parts.

According to exemplary embodiments, there is provided a method of forming a confectionery packaging as described above, the method comprising the steps of:

preforming a first part with main surfaces that substantially conform to part of the shape of a confectionery to be packaged and a flange that extends about a mouth of the preformed part;

placing the confectionery product in the first part; and sealing a second part to the flange of the first part such that at least one gripping portion is formed, wherein the gripping portion allows a consumer to grip the packaging in order to apply a separating force to separate one part from the other through the seal between the flanges.

Suitably the method comprises preforming the second part with main surfaces that substantially conform to part of the shape of a confectionery to be packaged and a flange that extends about a mouth of the preformed part.

Suitably the method comprises forming a fracture zone in one of the flanges.

According to exemplary embodiments, there is provided a packaging assembly comprising a confectionery packaging and a secondary packaging, the confectionery packaging comprising main surfaces that substantially correspond to the shape of the confectionery being packaged and an outwardly extending flange, and the secondary packaging comprises a surface having at least one aperture, wherein the secondary packaging provides a support to the confectionery packaging by abutment between the flange and surface.

Suitably multiple confectionery packages are provided and the surface of the secondary packaging includes a plurality of apertures.

According to exemplary embodiments, there is provided a method of packaging a confectionery package, wherein the method comprises supporting a flange of the confectionery package in a secondary packaging by abutment between the flange and a surface surrounding an aperture.

According to the exemplary embodiments, there is provided a confectionery packaging for a confectionery, the packaging comprising a first preformed part and a second part, wherein the first and second parts are sealed together about the confectionery at flanges that extend away from main surfaces of each part, said main surface substantially conforming to the shape of the confectionery;

a portion of at least one of the flanges being arranged to contact a linear plane that extends in first and second orthogonal directions when a portion of the main surface of one of the parts also contacts the linear plane.

A linear plane refers to a substantially flat surface on which the confectionery packaging may be placed in use. The linear plane is not part of the confectionery packaging.

Suitably the packaging is arranged such that the centre of gravity of the packaging acts between the contact between the plane and flange and the contact between the plane and main surface in one direction.

Suitably the packaging is arranged such that flange or main surface is adapted to provide two spaced contacts either side of the centre of gravity in the second direction.

Suitably the portion of the main surface that contacts the linear plane is adapted to provide a foot.

Suitably the foot provides a substantially flat surface of contact in one direction.

Suitably the foot provides a substantially flat surface contact in two directions.

Suitably the flanges are joined at a plane and the plane is substantially planar.

Suitably the flanges are joined at a plane and the plane is arcuate in at least one axis.

Suitably the flanges are joined at a plane and the plane is wavy in at least one axis.

Suitably the planes are arcuate or wavy in both axes.

Suitably the confectionery packaging has an elongate shape, for example egg-shaped, ovoid, ellipsoid or cylindrical.

Suitably the flanges are joined at a plane and the plane extends parallel to a major axis of the confectionery.

The major axis corresponds to the longest dimension of the confectionery packaging, wherein the confectionery packaging has an elongate shape.

Suitably the confectionery packaging comprises at least one entirely curved circumference, the flanges are joined at a plane and the plane extends around the longest entirely curved circumference of the confectionery packaging.

Suitably the confectionery packaging comprises at least two entirely curved circumferences which are orthogonal to each other (or at least extending in different directions), the flanges are joined at a plane and the plane extends around the longest entirely curved circumference of the confectionery packaging (i.e. in a plane including and parallel to the major axis).

Suitably the confectionery packaging is egg-shaped, ovoid or ellipsoid, the flanges are joined at a plane and the plane extends around the longest entirely curved circumference of the packaging.

Suitably the flanges are joined at a plane and the plane extends parallel to a minor axis of the confectionery.

The minor axis is orthogonal to the major axis; wherein the confectionery packaging has an elongate shape.

Suitably the confectionery packaging comprises at least two entirely curved circumferences which are orthogonal to each other (or at least extending in different directions), the flanges are joined at a plane and the plane extends in a plane orthogonal to the longest entirely curved circumference of the confectionery packaging (i.e. in a plane including and parallel to the minor axis).

Suitably the confectionery packaging is egg-shaped, ovoid or ellipsoid, the flanges are joined at a plane and the plane extends around the waist of the packaging. The waist of the packaging is the longest entirely curved circumference around the packaging which is orthogonal to the overall longest entirely curved circumference of the packaging (i.e. in a plane including and parallel to the minor axis).

Suitably the flanges are joined at a plane and the plane extends at an angle to a major or minor axis of the confectionery.

Suitably the flanges are joined at a plane and the plane extends at an angle between a major and a minor axis of the packaging.

Suitably the confectionery packaging comprises at least two entirely curved circumferences which are orthogonal to each other (or at least extending in different directions), the flanges are joined at a plane and the plane extends at an angle between the at least two entirely curved circumferences of the confectionery packaging.

Suitably the confectionery packaging is egg-shaped, ovoid or ellipsoid, the flanges are joined at a plane and the plane extends at an angle between the longest entirely curved circumference and the waist of the packaging.

Suitably the flanges are arranged to provide a gripping portion that allows a consumer to grip the packaging in order to apply a separating force to separate one part from the other through the seal between the flanges.

Suitably a first gripping portion is provided to allow a user to apply a separating force to one part and a second gripping portion is provided to allow a user to apply a separating force to the other part.

Suitably the first and second gripping portions are arranged adjacent each other.

Suitably the or each gripping portion is provided by at least a portion of one flange overlying at least a portion of the other flange, and the portion of the flange that overlies the other flange forms the gripping portion.

Suitably the or each gripping portion is provided by at least a portion of one flange overlying and extending beyond at least a portion of the other flange, and the portion of the flange that overlies and extends beyond the other flange forms the gripping portion.

Suitably a plurality of portions of said one flange overlay a corresponding plurality of portions of said other flange to provide multiple gripping portions.

Suitably a plurality of portions of said one flange overlies and extends beyond a corresponding plurality of portions of said other flange to provide multiple gripping portions.

Suitably one of the flanges includes a first fracture zone that is arranged to fracture said flange into a main part and a distal end part when a force is applied to the fracture zone, the or each gripping portion being formed by a portion of one flange and the distal end part of said other flange.

Suitably a plurality of fracture zones are provided in said flange in order to form multiple gripping portions.

Suitably the gripping portion is formed by the portion of the flange that contacts the linear plane.

Suitably the flange is adapted to provide the two spaced contacts in the second direction, and one of the spaced contacts forms a gripping portion to apply a separating force to one of the parts and the other of the spaced contacts forms a gripping portion to apply a separating force to the other of the parts.

According to exemplary embodiments, there is provided a method of forming a confectionery packaging as described above, the method comprising the steps of:

preforming a first part with main surfaces that substantially conform to part of the shape of a confectionery to be packaged and a flange that extends about a mouth of the preformed part;

placing the confectionery product in the first part; and sealing a second part to the flange of the first part such that a portion of at least one of the flanges is arranged to contact a linear plane that extends in first and second orthogonal directions when a portion of the main surface of one of the parts also contacts the linear plane.

Suitably the method comprises forming a gripping portion.

According to the exemplary embodiments, there is provided a confectionery packaging for a confectionery, the packaging comprising a first preformed part and a second part, wherein the first and second parts are sealed together about the confectionery at flanges that extend away from main surfaces of each part, said main surfaces substantially conforming to the shape of the confectionery;

said flanges of the first and second parts being brought together at a plane that extends at an angle to a major or minor axis of the confectionery.

The major axis corresponds to the longest dimension of the confectionery packaging, wherein the confectionery packaging has an elongate shape.

The minor axis is orthogonal to the major axis; wherein the confectionery packaging has an elongate shape.

Suitably the flanges are joined at a plane and the plane extends at an angle between a major and a minor axis of the packaging.

Suitably the confectionery packaging comprises at least two entirely curved circumferences which are orthogonal to each other (or at least extending in different directions), the flanges are joined at a plane and the plane extends at an angle between the at least two entirely curved circumferences of the confectionery packaging.

Suitably the confectionery packaging is egg-shaped, ovoid or ellipsoid, the flanges are joined at a plane and the plane extends at an angle between the longest entirely curved circumference and the waist of the packaging. The waist of the packaging is the longest entirely curved circumference around the packaging which is orthogonal to the overall longest entirely curved circumference of the packaging (i.e. in a plane including and parallel to the minor axis).

Suitably the plane is substantially planar.

Suitably the plane is arcuate in at least one axis.

Suitably the plane is wavy in at least one axis

Suitably the plane is substantially planar or wavy in both axes.

Suitably the flanges are adapted to include a gripping portion.

Various embodiments will be described herein and it will be appreciated that the features of the exemplary embodiments described above and the embodiments described herein can be combined in isolation or with other features of the same or other embodiments, except where those features are mutually exclusive.

BRIEF DESCRIPTION OF THE FIGURES

For a better understanding of the invention, and to show how embodiments of the same may be carried into effect, reference will now be made, by way of example, to the accompanying diagrammatic drawings in which.

DETAILED DESCRIPTION

Figure 1A:
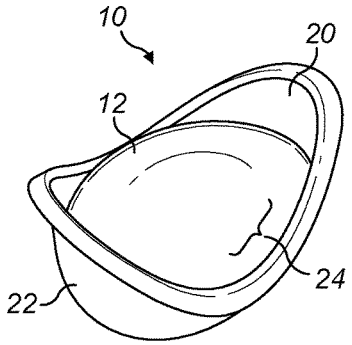
FIG. 1 shows isometric views of a first exemplary embodiment of a confectionery packaging.

The exemplary embodiments share many like features and these are indicated using the same reference numerals but, for brevity, not necessarily repeated descriptions.

Figure 1B:
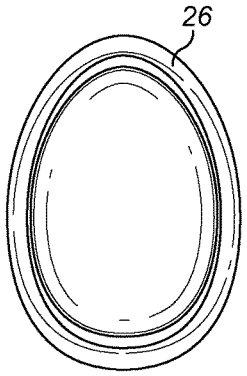
Figure 1C:
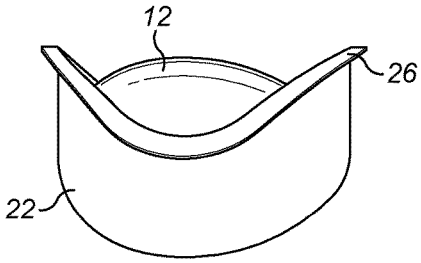
Figure 1D:
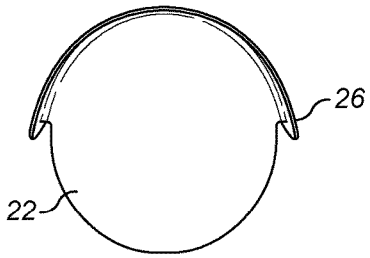
Figure 2A:
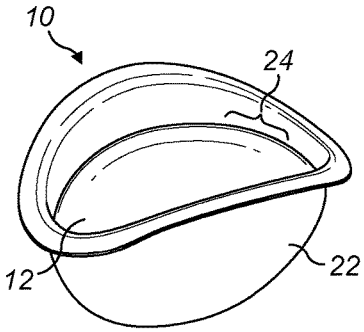
FIG. 2 shows isometric views of a second exemplary embodiment of a confectionery packaging.
Figure 2B:
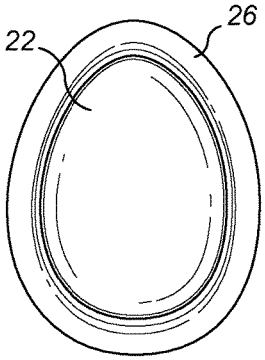
Figure 2C:
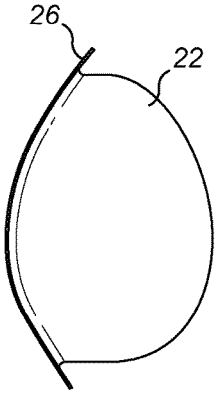

Referring to FIGS. 1 and 2 an exemplary embodiment of a confectionery packaging 10 is shown. The packaging 10 comprises a first part 20. The first part forms a preformed shell and is substantially rigid so that the part 20 maintains it shape. The first part 20 holds the product to be packaged, which in the Figures is shown as a confectionery egg 12. Main surfaces 22 of the first part 20 are shaped so as to substantially conform to the shape of the confectionery egg. In FIG. 1, the main surfaces 22 are show as substantially enclosing the egg 12, but this is not necessarily the case. Consequently an open mouth 24 to the part 20 is provided. The egg 12 is accessible through the open mouth 24. A flange 26 is formed about the perimeter of the open mouth 24. The flange extends away from the main surfaces 22 and is shown in FIG. 1 as being bent through an obtuse angle to the main surface surrounding the mouth 24.

Referring to FIG. 1B in particular, it can been seen that the flange extends continuously about the perimeter of the mouth and extends a substantial distance therefrom in order to provide a surface against which a second part (not shown in FIG. 1) can be sealed. In FIG. 1, the flange is shown as having a sealing surface that is at least 20% of the minimum distance across the mouth.

The confectionery packaging 10 forms a sealed enclosure about the egg 12 by sealing a second part to the flange 26. The second part is not shown in FIG. 1, and can be a second preformed shell or a flexible film. Here, flexible means the film does not hold its shape. The film is sealed to the flange using any known technique. To open the packaging, the film is separated from the first part 20, for instance by peeling back the film. It will be appreciated that the film may therefore, at least in part, overlap the flange to provide a grasping point to initiate the peeling process. Furthermore, shrink wrap technology can be employed to cause the film to conform to the shape of the part 20 and/or egg 12.

Figure 6:
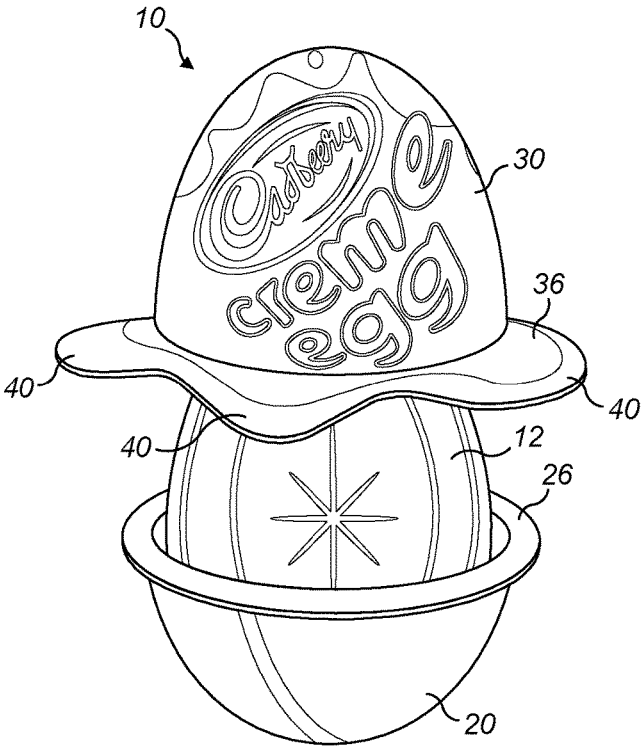
FIG. 6 shows a perspective view of a fifth exemplary embodiment of a confectionery packaging in a part open arrangement.

When reference is made to a portion of the flange that overlies or overlaps the other flange, it can be seen from at least FIG. 6 that the said portion of the flange overlies and extends beyond the other flange. The portion of the flange which extends beyond the other flange thereby provides the gripping/grasping portion.

There is therefore provided a packaging which provides an improved protection to the egg 12. For instance, tamper proof technology can be applied to the seal so that it becomes evident whether the seal has been broken. Moreover, it is easier to apply graphics to the preformed part and the graphics can be more reliably reproduced. The preformed part also provides a convenient holder for the egg to allow the user to consume the egg without having to touch the egg itself. Here, the flange provides a convenient stop for the use to rest their fingers against.

It will be appreciated from this last point that the shape of the preformed part 20 can be designed to allow the egg 12 to be easily held and consumed in order to improve the ability to consume the egg without having to touch the actual egg. For instance, in FIG. 1 the profile of the mouth is arranged to include a concave portion. The concave portion is best seen in FIG. 1C and allows a user's mouth to easily access the egg whilst the packaging is gripped. In FIG. 1, the concave portion is arranged along the length of the egg, whereas in FIG. 2, the concave portion is arranged across the width of the egg. Whilst the remaining embodiments will be described in relation to two preformed parts, it will be appreciated that one of the preformed part could be replaced with a foil.

Figure 3A:
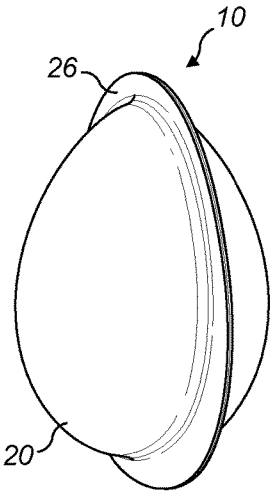
FIG. 3 shows isometric views of a third exemplary embodiment of a confectionery packaging.
Figure 3B:
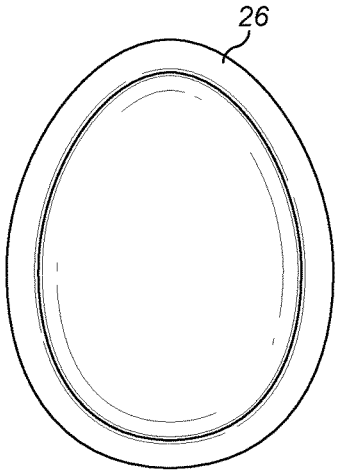
Figure 3C:
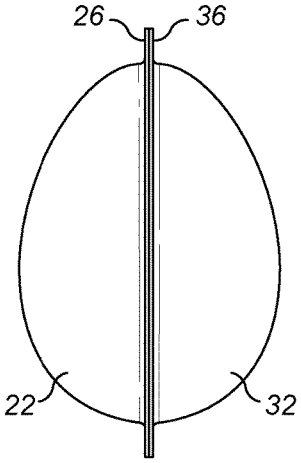

FIG. 3 shows a third embodiment of a confectionery packaging 10. The confectionery packaging 10 is formed from a first part 20. The first part 20 is preformed and includes a flange 26. The confectionery packaging is formed by sealing a second part 30 about an egg (not seen in FIG. 3). The second part 30 is shown in FIG. 3 as also being a preformed shell having a flange 36. Indeed, in FIG. 3, the first and second parts are substantially identical. That is, they may include different graphics, but the shapes are the same. The flanges 26, 36 are sealed together. The sealed flange extends about the packaging in a plane aligned to a tip-to-tip axis of the egg. The sealed flanges extend away from and orthogonal to the main surfaces 22, 32 adjacent the mouths of each part.

Figure 4:
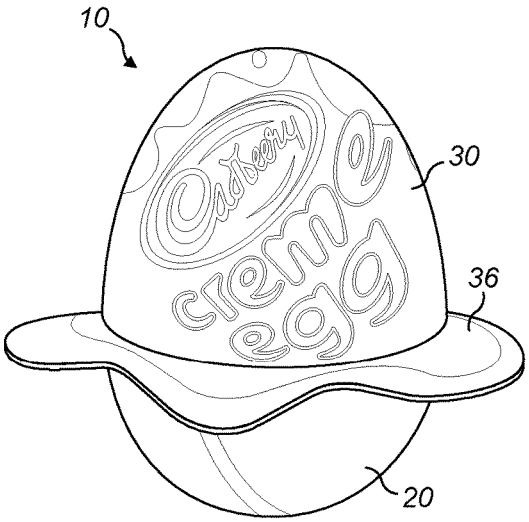
FIG. 4 shows an perspective view of a fourth exemplary embodiment of a confectionery packaging.

FIG. 4 shows a fourth embodiment, which shows a confectionery packaging 10 substantially similar to the third embodiment. That is first and second preformed shells 20, 30 are sealed together at flanges 26, 36 to enclose an egg (not seen). However, in FIG. 4, the sealed flanges extend about the packaging in a plane parallel to the waist of the egg. In FIG. 3, the two parts are identical. That is to say, the flange is formed along the centre of the egg. In FIG. 4, and because the egg does not have symmetry, the two parts are different. Each encloses at least 30% of the surface area of the egg and the mouths (not seen) formed in each part are formed at the widest art of the egg so that the egg can be removed from each part without deforming or breaking the egg. FIG. 4 also introduces the idea that the flanges can have an aesthetic quality and is not limited to extending a consistent distance from the main surfaces.

Figure 5:
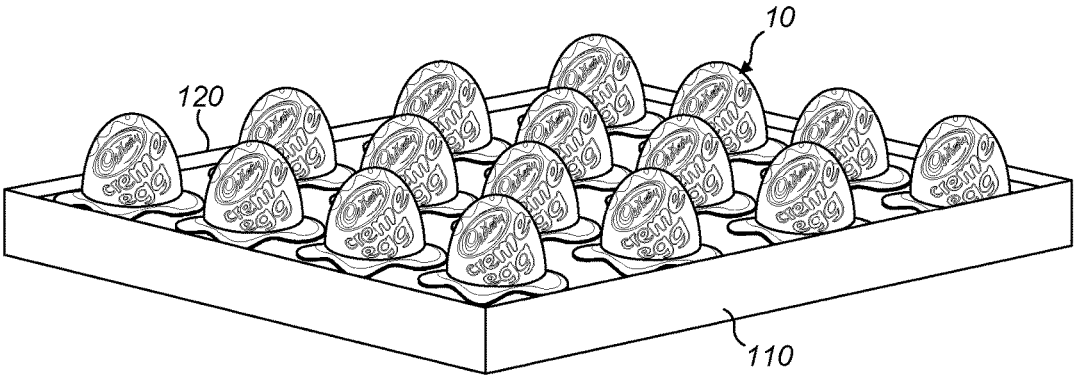
FIG. 5 shows a perspective view of the fourth exemplary embodiment held in a secondary packaging.

As well as providing enhanced holding characteristics, the exaggerated flanges also enable the confectionery packages 10 to be held conveniently in a secondary packaging 110. For instance, as shown in FIG. 5, a secondary packaging 110 comprising a surface 120 with a plurality of apertures for receiving each package 10 is provided. Each aperture is sized so as to fit the main surfaces 22 of the packing. The packaging 20 is prevented from falling through the surface 120 by abutment between the flanges and the surface 120. The packaging 10 is therefore suspended within the secondary packaging 110. Consequently a convenient and protective secondary packaging is provided to supply multiple confectionery packages 10.

In the exemplary embodiments described herein, the confectionery packaging 10 is opened by separating the first part from the second part along the flange seal. FIG. 6 shows an embodiment having an improved opening. Here, the opening of the packaging 10 is improved by providing a gripping portion 40 that a consumer can use to grip the packaging and peel back one of the parts. In FIG. 6, the gripping portion is provided by arranging the flanges to fit in register with each other. For instance, at least a part of one of the flanges is larger than the corresponding part of the other flange so that said flange overlies the other flange. A continuous seal can still be formed between the flanges, but a gripping portion is formed that comprises a part of just one of the flanges. In FIG. 6, the flange 36 of the second part is adapted to be oversized relative to flange 26 of the first part in its entirety or at regular intervals around the periphery of the flange. The gripping portions allow the consumer to grip said part and pull back the one part relative to the other. Because the gripping part 40 only includes a portion of one of the flanges, the separation of the two parts is easily initiated as the user is applying a separating force to one part only.

Figure 7:
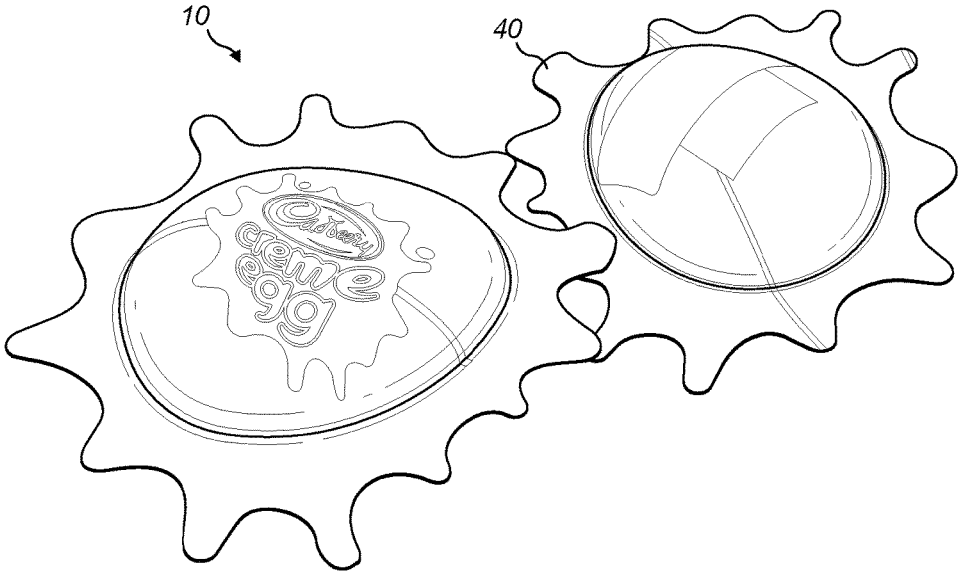
FIG. 7 shows front and rear perspective views of a sixth exemplary embodiment of a confectionery packaging.

FIG. 7 shows an alternative embodiment wherein the gripping portion 40 is provided in a discrete position of the packaging 10 by overlaying only a portion of one of the flanges.

Figure 8:
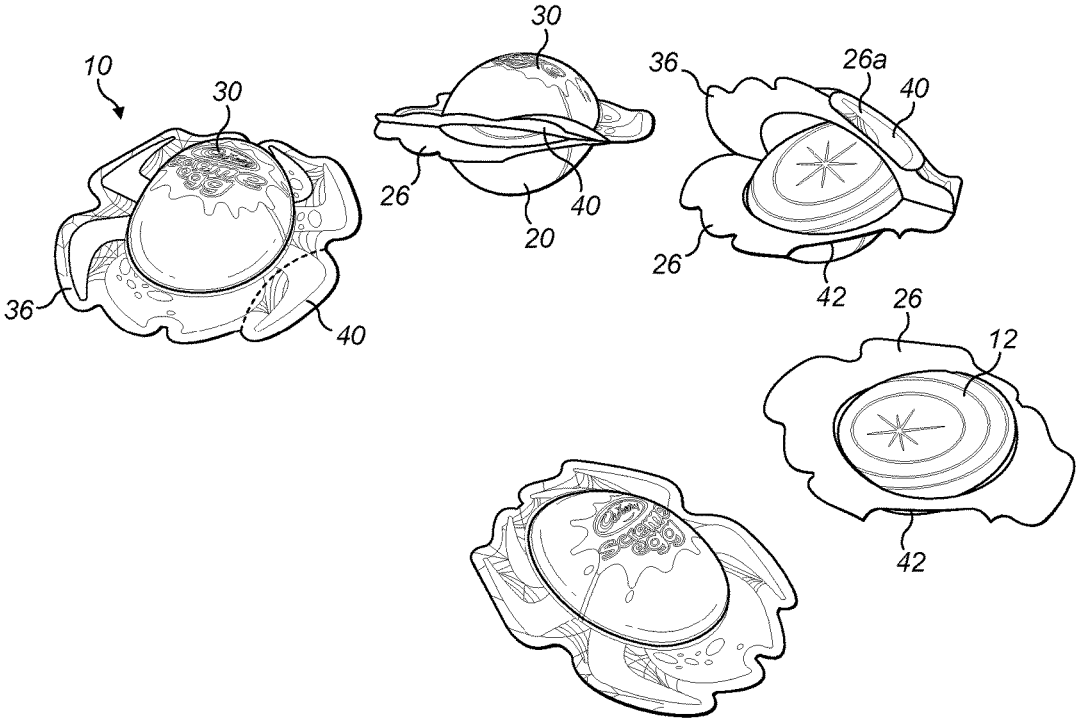
FIG. 8 shows perspective views of an opening process of a seventh exemplary embodiment of a confectionery packaging.

FIG. 8 shows a seventh exemplary embodiment of a confectionery packaging 10 formed of two parts 20, 30 that are joined by a flange seal. Here, a gripping portion is provided to improve the opening characteristics in a similar manner to the previous embodiment. However, in this case, as can be seen from FIG. 8, the gripping portion 40 includes a portion of both flanges. Here, the flanges are arranged in register with each other. The gripping portion achieves the opening objectives of allowing a consumer to apply a separation force easily to just one of the parts by providing a weakened line through one of the flanges. The weakened line is arranged to fracture when a stress is applied. For instance, in FIG. 8, when the gripping part 40 is bent sharply, upwards at the weakened line, the weakened line fractures so that a portion of the first flange 26*a* is separated from the main portion of the flange 26. Here the gripping portion 40 includes the part of the flange seal including the fractured minor part of flange 26*a*. As can be seen, edge 42 is formed in the flange 26 when packaging is opened wherein edge 42 corresponds to the weakened line.

Figure 9:
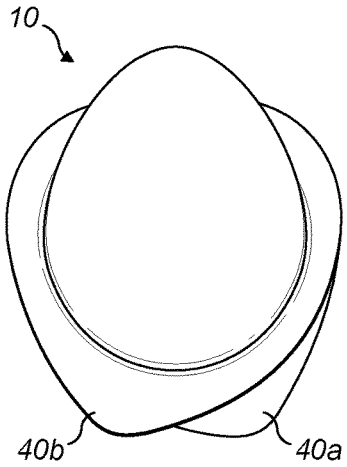
FIG. 9 shows a perspective view of an eighth exemplary embodiment of a confectionery packaging.
Figure 10A:
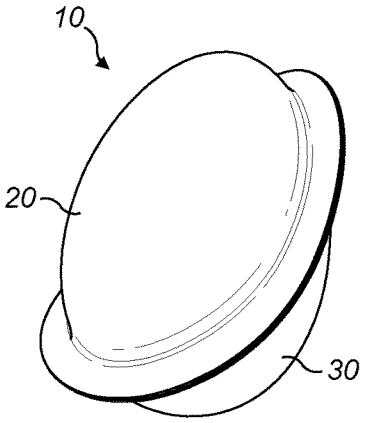
FIGS. 10 to 16 show perspective views respectively of ninth to fifteenth embodiments of a confectionery packaging.
Figure 10B:
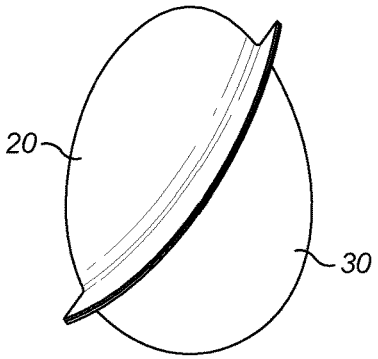
Figure 10C:
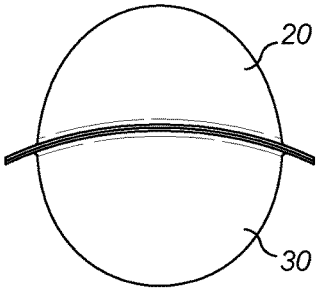
Figure 10D:
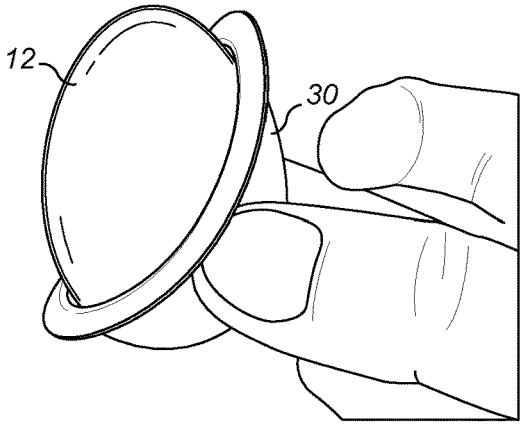
Figure 11A:
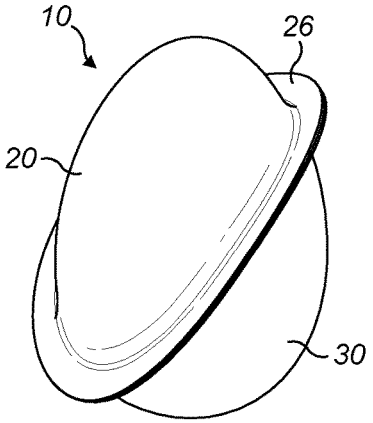
Figure 11B:
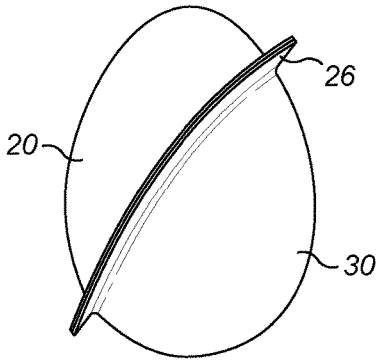
Figure 11C:
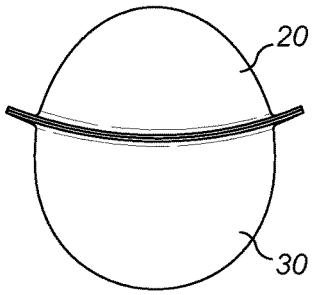
Figure 11D:
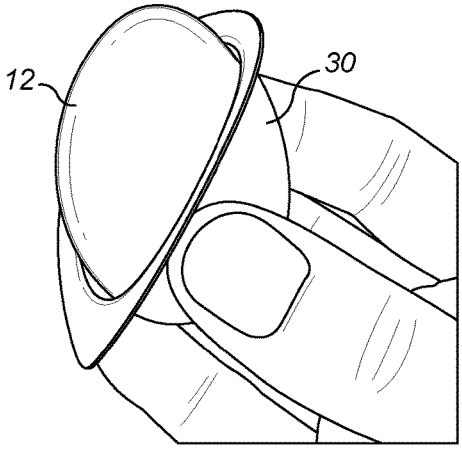
Figure 12A:
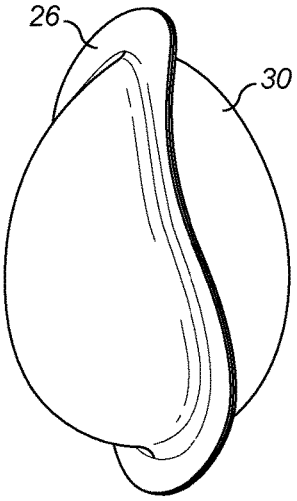
Figure 12B:
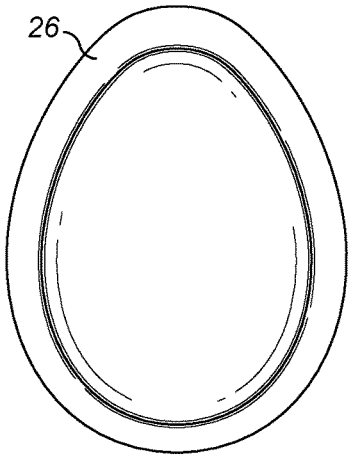
Figure 12C:
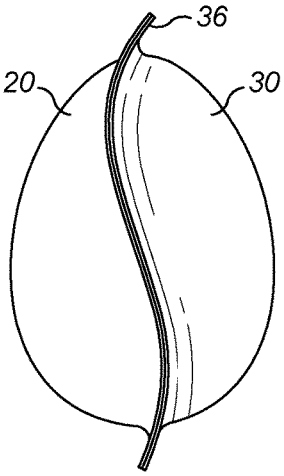
Figure 12D:
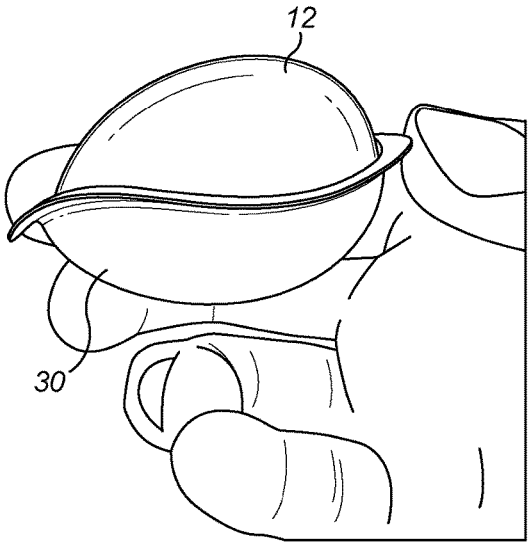

FIG. 9 shows a further exemplary embodiment of a confectionery packaging 10. Here a plurality of gripping portions 40 is provided. For instance a first gripping portion 40*a* and a second gripping portion 40*b*. One of the gripping portions is designed to allow a consumer to apply an opening force only to one part and the other of the gripping portions is designed to allow a consumer to apply an opening force only to the other of the parts. It will be appreciated that the gripping portions 40 can be formed either by oversizing the respective part or by providing a weakened line. In FIG. 9, the packaging is shown as having a first gripping part 42*a* where the flange of the lower part overlies the flange of the upper part and a second gripping part 42*b* where the flange of the upper part overlies the flange of the lower part.

FIG. 10 shows a ninth embodiment of a confectionery packaging 10. As previously described, the packaging 10 provides a sealed enclosure for an egg 12 by sealing first 20 and second 30 preformed parts. Each part includes a flange that extends about a periphery of a mouth to each part. The flanges extend away from major surfaces of each part that are designed to substantially conform to the shape of the packaging. The sealed flanges are arranged to circumnavigate the packaging so that access to the egg 12 is gained by separating the two parts along the flange seal. In FIG. 10, the flanges are arranged to extend substantially along a plane that is inclined to one of the natural axis of the egg. That is one of the parts encloses all of one end or side of the egg and the other part encloses all of the other end or side of the egg. This enables the whole of one end or side of the egg to be uncovered and improves the ability to eat the egg whilst holding the egg through the remaining packaging.

In some previous embodiments, the plane in which the flanges are arranged have been substantially planar. Whilst the flanges arranged on a slanted plane can also be substantially planar, in FIG. 10, the flanges are shown as being arranged to be slanted across the egg on an arcuate plane. In addition, the plane that the flanges are arranged in FIG. 10 is shown as being arcuate in two dimensions. Again however, the plane could be substantially linear in one or both dimensions.

Figure 13A:
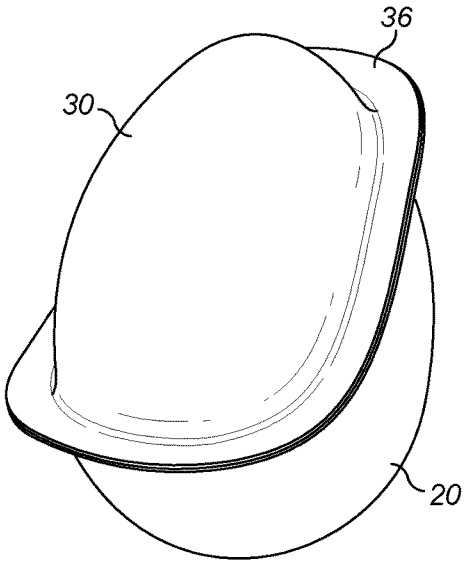
Figure 13B:
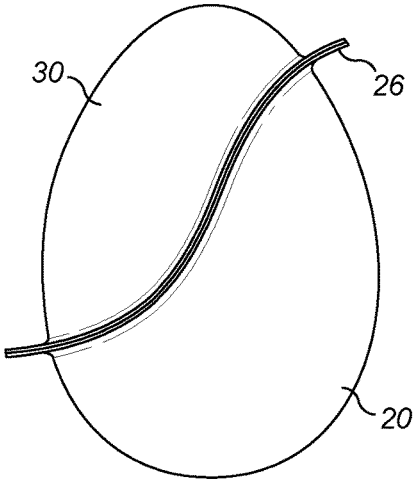
Figure 13C:
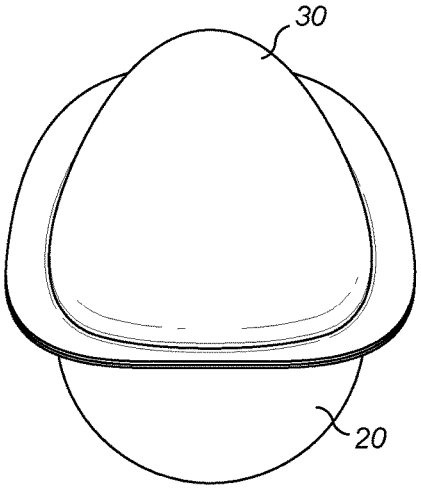
Figure 15:
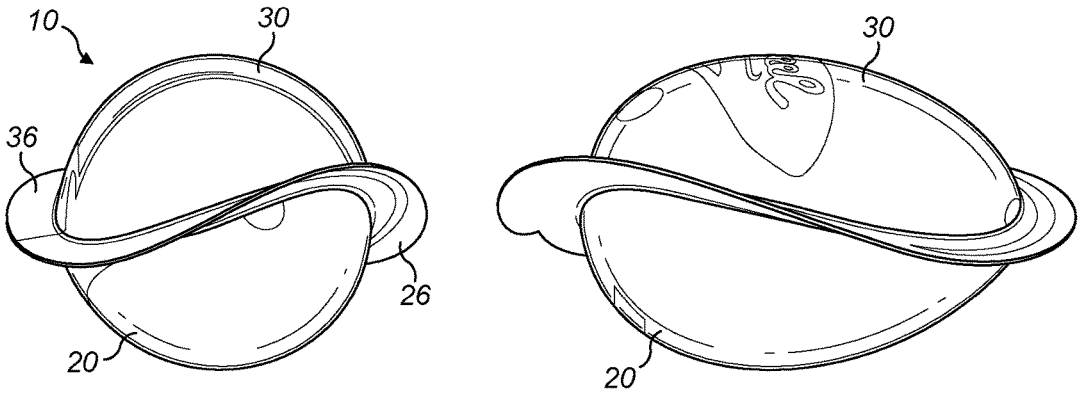

FIG. 11 shows a further embodiment that is similar to FIG. 10, wherein the slanted plane is arcuate in an alternative direction. The design choice in terms of shape of the plane in which the flanges meet is dependent on the preferred eating characteristics and selected to optimise the eggs ability to be consumed whilst holding the egg through the remaining packaging part. Furthermore, the design of the plane can be adapted to suit different situations readily whilst maintaining the principles of a confectionery packaging formed of two parts that are joined along a flange seal and features of each embodiment can be readily combined with other features independently or in combination. For instance, FIG. 12 shows an example of a wavy plane arranged substantially in the tip-to-tip direction. The plane is wavy because it includes at least one peak and at least one trough when viewed from any particular side. FIG. 13 shows an example of a wavy plane in a slanted direction and FIG. 15 shows an example wherein the plane is wavy in both dimensions.

FIG. 14 shows a particularly exemplary embodiment wherein the sealed flanges are arranged to contact a level surface when a part of the main surface of one of the parts is also in contact with the level surface. In FIG. 14, the plane of the flange is shown as being slanted which enables the egg shape to also meet the level surface. However, other flange arrangements will also provide the requirements particularly if they are shaped or enlarged. When viewed from the side, FIG. 14*a*, the flange contact the level surface at point 50 and the main part of the packaging at point 52. Although in FIG. 14, when the points 50, 52 rest on the level surface, the egg is shown as standing substantially upright, it will be appreciated that other orientation can be achieved by different design of the flange. The advantage of arranging the flange to contact the level surface at the same time as a part of the main surfaces is that the packaging can be stood in a stable orientation and is therefore less susceptible to rolling and enables the aesthetics of the packaging to be more repeatable when at the point of sale. The stable arrangement is achieved by arranging points 50 and 52 to be either side of the centre of gravity (depicted by arrow A) of the packaging. Whilst the centre of gravity may be arranged to act through one of the points, a more stable arrangement is achieved by arranging the centre of gravity to act through a location spaced from both points.

Figure 14A:
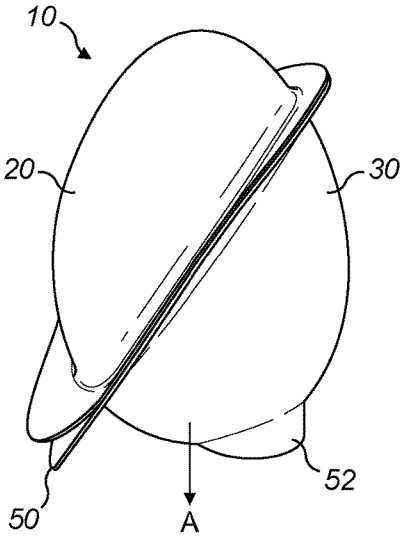
Figure 14B:
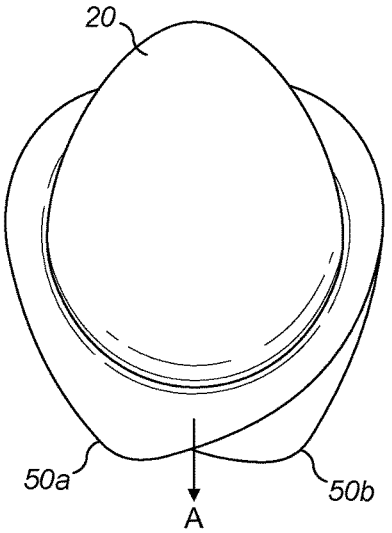
Figure 14C:
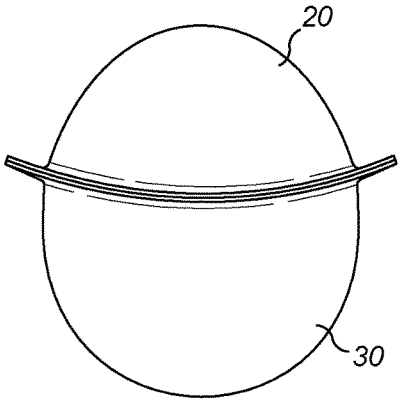
Figure 14D:
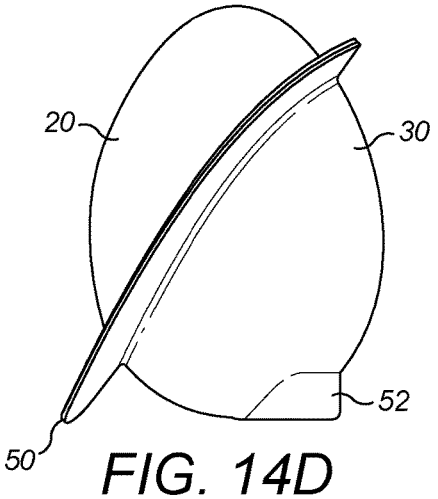

Furthermore, one of the points 50, 52 is shown in the exemplary embodiment as being spaced either side of the centre of gravity in a direction orthogonal to the first view. For instance, in FIG. 14*b*, the flanges are shown as extending down in two locations 50*a* and 50*b*, both of which are arranged to touch the level surface when the packaging is stood thereon. Again the locations 50*a*, 50*b* are arranged either side of the centre of gravity. In FIG. 14*b* the flanges are shown as extending at two discrete locations. However, the points 50*a*, 50*b* may also be parts of a continuous edge.

The stability of the packaging when stood on the surface may be enhanced by including a stand feature 52 such as a rib at the point of contact between the main surface and floor. Here, the stand feature 52 is arranged to provide a wider base for the contact and may additionally provide extra contact points spaced either side of the centre of gravity in addition to or as an alternative to the spaced locations of the flange 50*a*, 50*b*.

Figure 16:
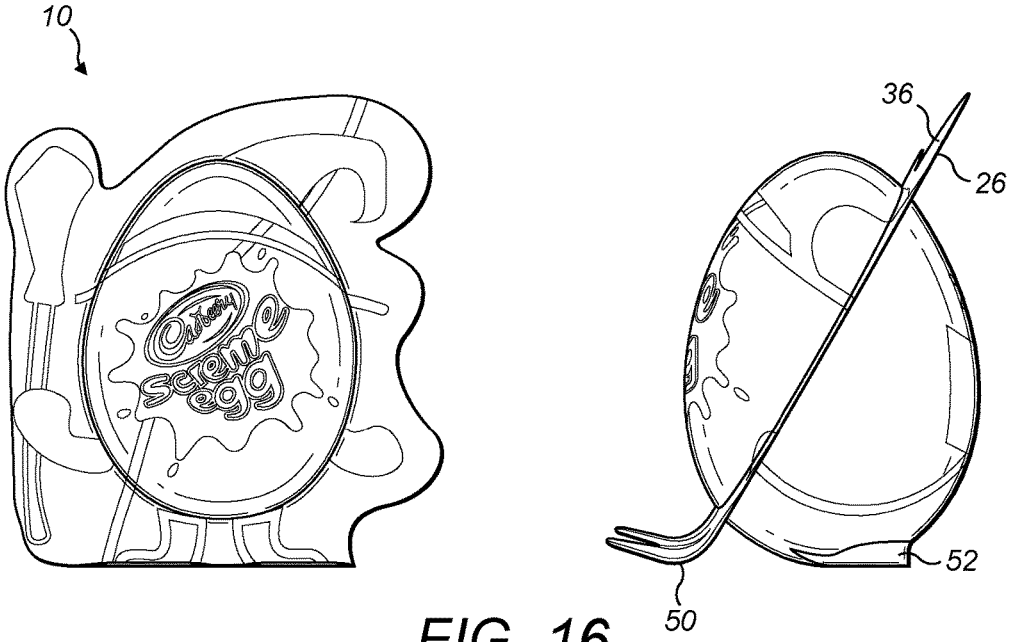

Referring to FIG. 16, an exemplary embodiment is shown wherein the stability has been further improved by bending the flange seal at the distal end so that a foot is provided to come into contact with the surface when the packaging is stood up. Again, the foot enhance the stability by providing a larger area or contact and the bend enables tolerances in assembly and/or manufacture to be accommodated.

Since the stability of the pack depends on the centre of gravity, an optional feature is to apply a weight to the packaging to provide a localised increase in mass in order to shift the centre of gravity. The weight may also provide a fun wobble factor to the packaging.

Figure 17:
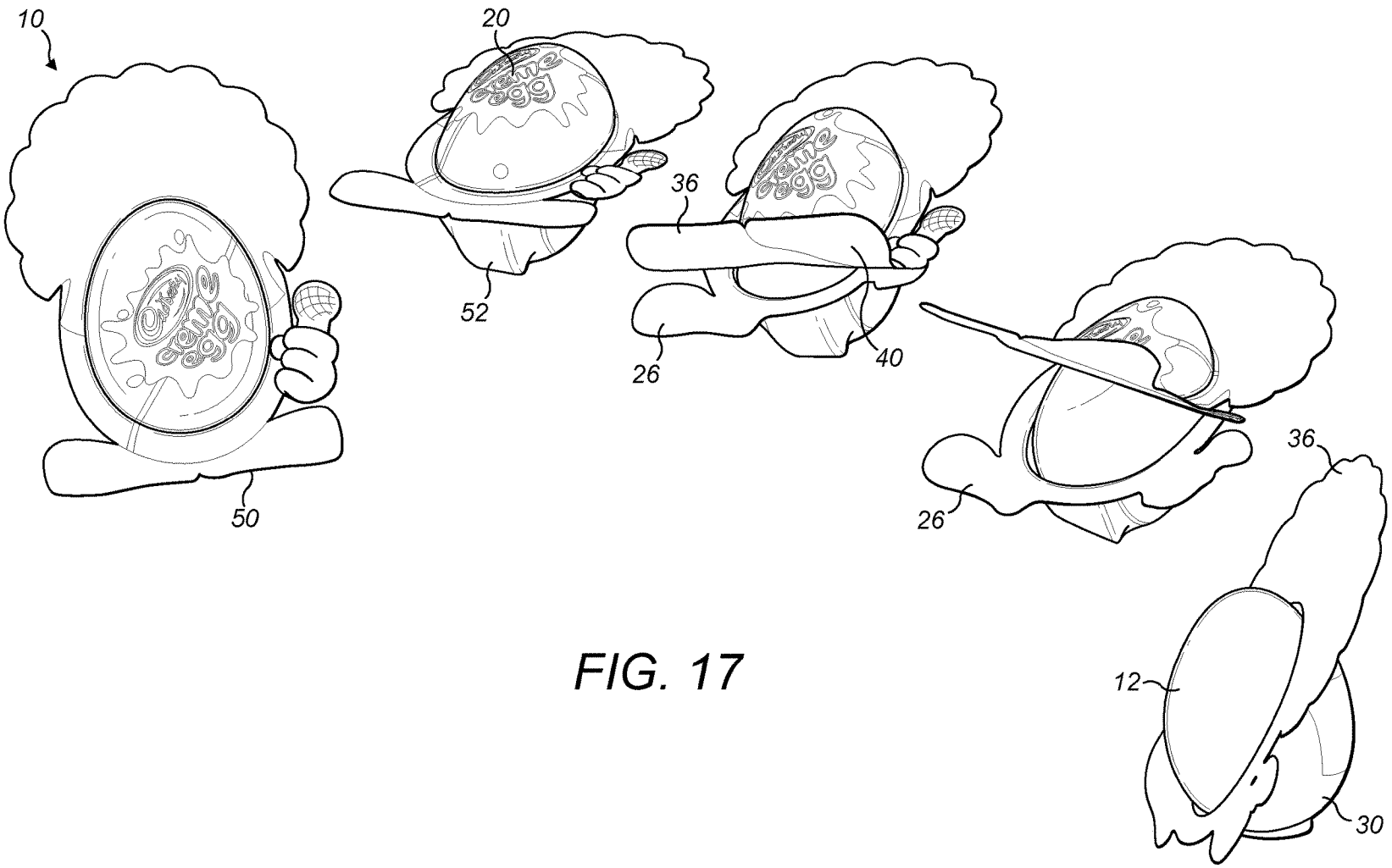
FIG. 17 shows perspective views of an opening process of a sixteenth exemplary embodiment of a confectionery packaging.

FIG. 17 shows an opening sequence of a particularly exemplary embodiment. Here, the confectionery packaging 10 is formed of two preformed shells 20, 30 that are sealed together at a flange sel. The flanges are exaggerated and given an aesthetic appeal. Moreover, a portion of the flanges 50 and a stand 52 are provided and arranged to contact a surface to allow the packaging to be stably stood so that the promotional message of the packaging can be reproduced. The packaging is opened using a grasping portion 40 and peeling back one part from the other along the flange seal. The flanges 26, 36 are arranged along a slanted plane so that when one of the parts is removed, the bottom of the egg is cupped by the remaining part and the top of the egg is conveniently provided to the consumer so that they can consume the egg whilst holding it through the packaging.

Figure 18:
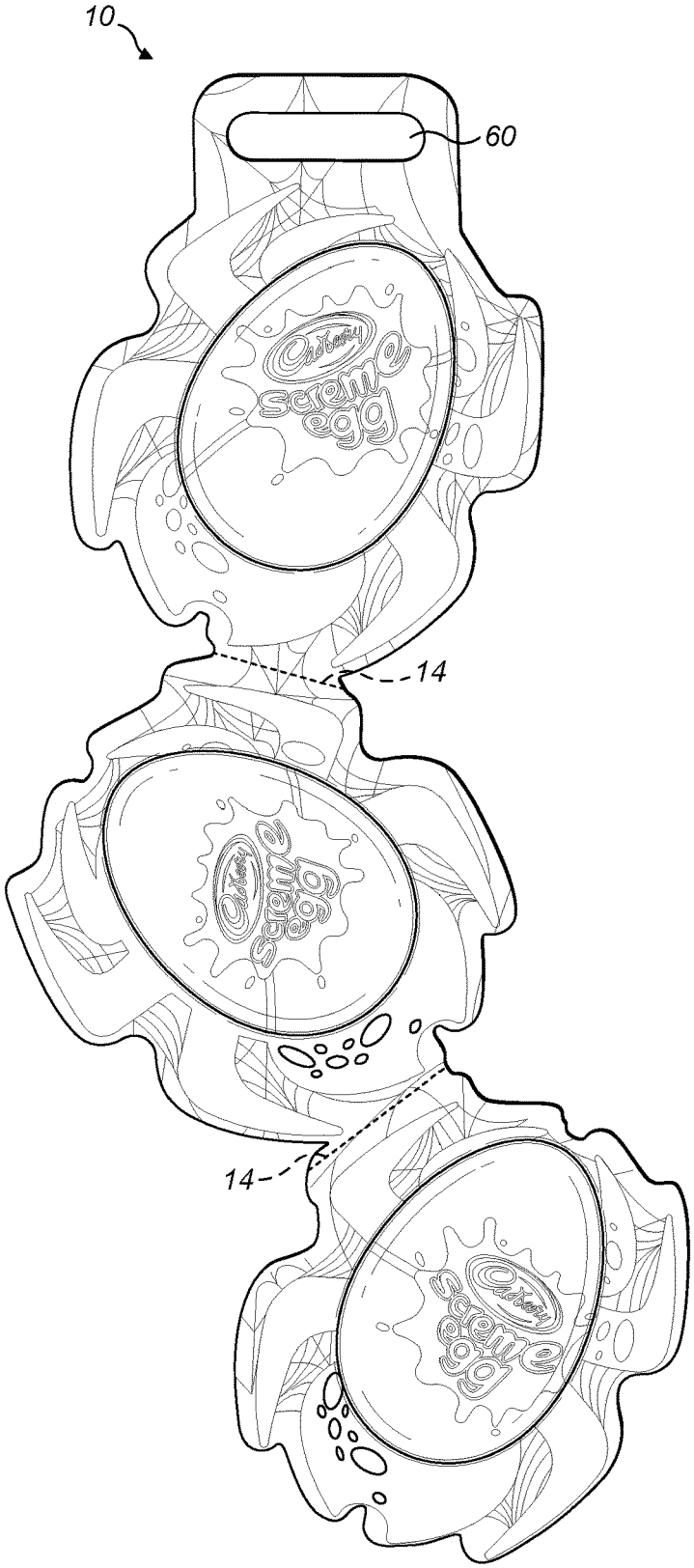
FIGS. 18 and 19 show plan views of seventeenth and eighteenth exemplary embodiments of a confectionery packaging respectively
Figure 19:
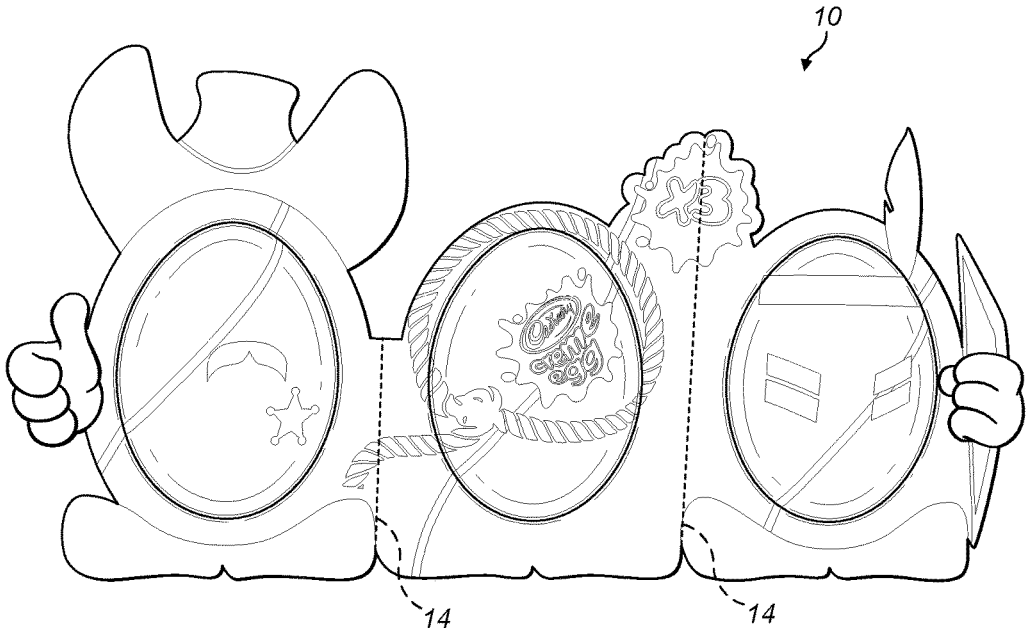

FIGS. 18 and 19 show further exemplary embodiments wherein multiple eggs have been provided in a single packaging 10. Here, perforations or fracture lines 14 are provided to enable a consumer to separate the packaging into single packages. Here, the single packages are substantially as herein described, wherein the large packages are formed by joining multiple packages through the flanges. Furthermore, FIG. 18 shows an optional feature whereby an aperture 60 is formed through the flange seal or one of the flanges so as to enable the packaging to be hung from a display. It will be appreciated that an aperture can be provided in any of the embodiments herein described.

Although preferred embodiment(s) of the present invention have been shown and described, it will be appreciated by those skilled in the art that changes may be made without departing from the scope of the invention as defined in the claims.

The invention claimed is:

1. Ovoid confectionery packaging for a confectionery product that is ovoid in shape, the packaging comprising a first preformed part that is rigid and a second preformed part that is rigid, wherein the first and second preformed parts are sealed together about the confectionery product at flanges that extend away from main surfaces of each of the first and second preformed parts, wherein the first and second preformed parts are joined only by the sealing, wherein said main surfaces of each of the first part and second part are shaped so that a formed internal space substantially conforms to the ovoid shape and size of the confectionery packaging, and wherein the flanges extend parallel to a minor waist axis of the confectionery product;

the flanges being arranged to provide a distinct gripping portion that allows a consumer to grip the packaging in order to apply a separating force to separate the first and second preformed parts through the seal between the flanges.

2. The confectionery packaging of claim 1 wherein a first gripping portion is provided to allow a user to apply a separating force to one of the first and second preformed parts and a second gripping portion is provided to allow a user to apply a separating force to the other of the first and second preformed parts.

3. The confectionery packaging of claim 2, wherein the first and second gripping portions are arranged adjacent each other.

4. The confectionery packaging of claim 1, wherein the gripping portion is provided by at least one portion of one flange overlying at least one portion of the other flange, and the portion of the flange that overlies the other flange forms the gripping portion.

5. The confectionery packaging of claim 4, wherein the gripping portion is multiple gripping portions, and a plurality of portions said at least one portion of said one flange overlay a corresponding plurality of portions said at least one portion of said other flange to provide multiple gripping portions.

6. The confectionery packaging of claim 1, wherein one of the flanges includes a first fracture zone that is arranged to fracture said flange into a main part and a distal end part when a force is applied to the fracture zone, the or each gripping portion being formed by a portion of one flange and the distal end part of said other flange.

7. The confectionery packaging of claim 6, wherein a plurality of fracture zones are provided in said flange in order to form multiple gripping portions.

8. The confectionery packaging of claim 1 wherein the flanges are joined at a plane and the plane is substantially planar.

9. The confectionery packaging of claim 1 wherein the flanges are joined at a plane and the plane is arcuate in at least one axis.

10. The confectionery packaging of claim 1 wherein the flanges are joined at a plane and the plane is wavy in at least one axis.

11. The confectionery packaging of claim 9, wherein the planes are arcuate or wavy in both axes.

12. The confectionery packaging of claim 1 wherein the flanges are joined at a plane and the plane extends parallel to a major axis of the confectionery product.

13. The confectionery packaging of claim 1 wherein the flanges are joined at a plane and the plane extends parallel to a minor axis of the confectionery product.

14. The confectionery packaging of claim 1 wherein the flanges are joined at a plane and the plane extends at an angle to a major or minor axis of the confectionery product.

15. The confectionery packaging of claim 1, wherein at least one of the flanges is arranged to extend so that a portion of at least one of the flanges is arranged to contact a linear plane that extends in first and second orthogonal directions when a portion of the main surface of one of the parts also contacts the linear plane.

16. The confectionery packaging of claim 15, wherein the packaging is arranged such that the centre of gravity of the packaging acts between the contact between the plane and flange and the contact between the plane and main surface in one direction, and the flange or main surface being adapted to provide two spaced contacts either side of the centre of gravity in the second direction.

17. The confectionery packaging of claim 15, wherein the portion of the at least one of the flanges that extends to contact the linear plane includes a gripping portion.

18. The confectionery packaging of claim 16, wherein the flange is adapted to provide the two spaced contacts in the second direction, and one of the spaced contacts forms a gripping portion to apply a separating force to one of the parts and the other of the spaced contacts forms a gripping portion to apply a separating force to the other of the parts.

19. A method of forming ovoid confectionery packaging for a confectionery product that is ovoid in shape, the method comprising:

preforming a first part that is rigid and includes a main surfaces that substantially conform to part of the shape of a confectionery product to be packaged and a first flange that extends about a mouth of the first preformed part, the first flange extending parallel to a minor, waist, axis of the confectionery packaging;

preforming a second part that is rigid and includes a main surface that substantially conform to part of the shape of a confectionery product to be packaged and a second flange that extends about a mouth of the second preformed part, the second flange extending parallel to a minor, waist, axis of the confectionery packaging;

placing the preformed confectionery product in the first part; and sealing the second flange of the second part to the first flange of the first part such that the two preformed parts are joined only by the sealing, and such that at least one distinct gripping portion is formed, wherein the gripping portion allows a consumer to grip the packaging in order to apply a separating force to separate one part from the other through the seal between the flanges, wherein said preforming of said first part and said second part includes forming said main surfaces of each of said first part and said second part such that said sealing results in an internal space that substantially conforms to the ovoid shape and size of the confectionery product.

20. The method of claim 19, wherein the method comprises forming a fracture zone in one of the flanges.

* * * * *